US007906261B2

(12) United States Patent
Yagi et al.

(10) Patent No.: US 7,906,261 B2
(45) Date of Patent: Mar. 15, 2011

(54) ELECTROPHOTOGRAPHIC PHOTORECEPTOR, AND IMAGE FORMING APPARATUS AND PROCESS CARTRIDGE USING THE SAME

(75) Inventors: Shigeru Yagi, Kanagawa (JP); Takeshi Iwanaga, Kanagawa (JP); Masayuki Nishikawa, Kanagawa (JP); Nobuyuki Torigoe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 138 days.

(21) Appl. No.: 12/332,092

(22) Filed: Dec. 10, 2008

(65) Prior Publication Data

US 2009/0253061 A1 Oct. 8, 2009

(30) Foreign Application Priority Data

Apr. 4, 2008 (JP) ..... 2008-098477

(51) Int. Cl.
*G03G 5/06* (2006.01)

(52) U.S. Cl. ..... 430/66; 430/57.1; 430/58.05; 430/58.8; 430/60

(58) Field of Classification Search ..... 430/57.1, 430/58.05, 58.8, 60, 66
See application file for complete search history.

(56) References Cited

U.S. PATENT DOCUMENTS

| | | | | |
|---|---|---|---|---|
| 5,422,209 | A * | 6/1995 | Ono et al. | 430/57.6 |
| 2003/0059694 | A1 * | 3/2003 | Tomiuchi et al. | 430/59.6 |
| 2008/0070138 | A1 * | 3/2008 | Yagi et al. | 430/66 |
| 2008/0075504 | A1 * | 3/2008 | Yagi | 399/159 |
| 2008/0254379 | A1 * | 10/2008 | Iwanaga et al. | 430/66 |

FOREIGN PATENT DOCUMENTS

| | | |
|---|---|---|
| JP | A-2-110470 | 4/1990 |
| JP | A-11-186571 | 7/1999 |
| JP | A-2003-027238 | 1/2003 |
| JP | A-2003-316053 | 11/2003 |
| JP | A-2004-151519 | 5/2004 |

* cited by examiner

*Primary Examiner* — Hoa V Le
(74) *Attorney, Agent, or Firm* — Oliff & Berridge, PLC

(57) ABSTRACT

An electrophotographic photoreceptor includes a conductive substrate, and a photosensitive layer, an intermediate layer having a thickness of 2 nm to 70 nm, and a surface layer, which are disposed in this order on the conductive substrate. The refractive index n1 of the photosensitive layer, the refractive index n2 of the intermediate layer, and the refractive index n3 of the surface layer satisfy an inequality, n2>n3>n1.

17 Claims, 10 Drawing Sheets

ELECTROPHOTOGRAPHIC PHOTORECEPTOR, AND IMAGE FORMING APPARATUS AND PROCESS CARTRIDGE USING THE SAME

CROSS-REFERENCE TO RELATED APPLICATION

This application is based on and claims priority under 35 USC 119 from Japanese Patent Application No. 2008-098477 filed on Apr. 4, 2008.

BACKGROUND

1. Technical Field

The invention relates to an electrophotographic photoreceptor for use in, for example, a copying machine that forms an image by an electrophotographic method, and a process cartridge and an image-forming apparatus using the electrophotographic photoreceptor.

2. Related Art

In recent years, the electrophotographic method has been used widely, for example, in copying machines and printers. An electrophotographic photoreceptor for use in image-forming apparatuses utilizing the electrophotographic method (hereinafter, sometimes referred to as a "photoreceptor") comes into contact with various materials and is exposed to various stresses in the apparatus and thus deteriorates gradually. On the other hand, digitalization and colorization of image-forming apparatuses demand that the photoreceptor have high reliability.

Specifically, for example, the following issues can be mentioned in connection with the process of charging the photoreceptor. For example, in non-contact charging, discharge products deposit on the photoreceptor, which cause image blurring or the like. In order to remove the discharge products deposited on the photoreceptor, for example, a system in which particles having a polishing function are added to a developer and the developer is removed in a cleaning unit is used. However, in such a system, a surface of the photoreceptor is deteriorated gradually due to abrasion. In recent years, contact charging has been widely employed. However, the contact charging may accelerate abrasion of the photoreceptor as well.

Because of these issues, prolongation of the lifetime of electrophotographic photoreceptors has been required. In order to prolong the lifetime of electrophotographic photoreceptors, improvement in abrasion resistance is required, and thus increase in the hardness of a photoreceptor surface is needed.

SUMMARY

An aspect of the invention provides an electrophotographic photoreceptor including a conductive substrate, and a photosensitive layer, an intermediate layer having a thickness of 2 nm to 70 nm (or about 2 nm to about 70 nm) and a surface layer, which are disposed in this order on the conductive substrate, a refractive-index n1 of the photosensitive layer, a refractive index n2 of the intermediate layer, a refractive index n3 of the surface layer satisfying the following Inequality (1).

$$n2>n3>n1 \qquad \text{Inequality (1)}$$

BRIEF DESCRIPTION OF THE DRAWINGS

Exemplary embodiments of the invention will be described in detail based on the following figures, wherein.

DETAILED DESCRIPTION

Figure 1:
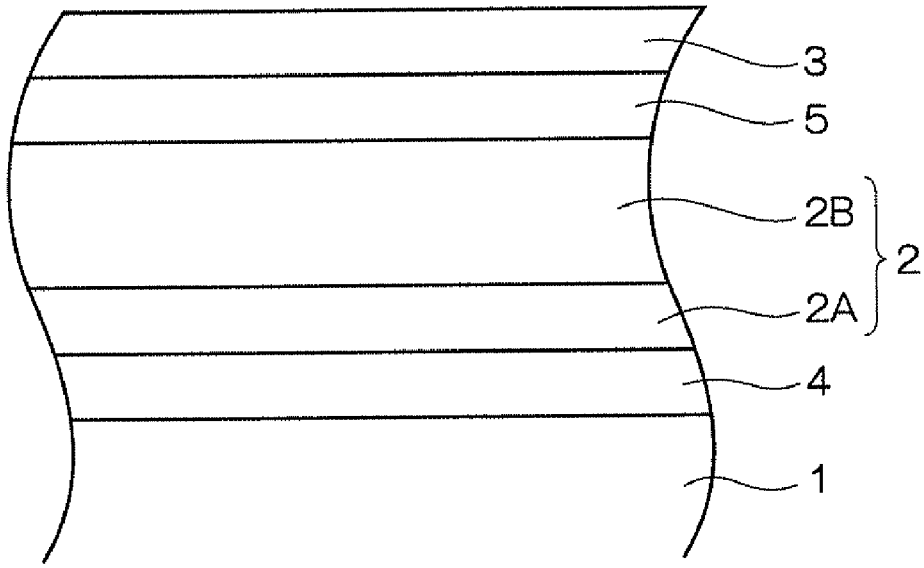
FIG. 1 is a schematic sectional view illustrating an example of the layer structure of a photoreceptor of an exemplary embodiment of the invention.

Hereinafter, an exemplary embodiment of the invention will be described in detail.

Electrophotographic Photoreceptor

The electrophotographic photoreceptor (hereinafter, also referred to as a "photoreceptor") of the exemplary embodiment includes a conductive substrate, and a photosensitive layer, an intermediate layer, and a surface layer disposed in this order on the conductive substrate. The layer thickness of the intermediate layer is from 2 nm to 70 nm (or about 2 nm to about 70 nm), and the refractive-index n1 of the photosensitive layer, the refractive index n2 of the intermediate layer, and the refractive index n3 of the surface layer satisfy the following Inequality (1).

$$n2>n3>n1 \qquad \text{Inequality (1)}$$

In general, when a photosensitive layer having a certain refractive index is overlaid with a surface layer having a refractive index higher than that of the photosensitive layer, the intensity of light, which has been irradiated to the photoreceptor and reflected from the surface layer of the electrophotographic photoreceptor (hereinafter, simply referred to as "reflected light from the surface layer"), is higher than the intensity of light that has been irradiated to the photoreceptor and reflected from the photosensitive layer positioned at a lower layer side of the surface layer (hereinafter, simply referred to as "reflected light from the photosensitive layer"). When the thickness of the surface layer becomes uneven due to abrasion or the like, optical interference occurs depending on the layer thickness, whereby image density in an image formed by an image-forming apparatus may become uneven.

In the electrophotographic photoreceptor of the exemplary embodiment of the invention, an intermediate layer is disposed between the photosensitive layer and the surface layer, the layer thickness of the intermediate layer is as thin as falling in a range of 2 nm to 70 nm, and the refractive indices of the photosensitive layer, the surface layer, and the intermediate layer satisfy the above Inequality (1), whereby unevenness in image density is suppressed.

Specifically, when the photoreceptor has a structure in which a surface layer having a refractive index higher than that of the photosensitive layer is formed on the photosensitive layer without an intermediate layer therebetween, interference between the reflected light from the photosensitive layer and the reflected light from the surface layer is increased, and becomes large. Therefore, intensity variation of the reflected light from the photoreceptor due to unevenness in the thickness of the intact surface layer and/or unevenness in the layer thickness caused by abrasion is increased, and, resultantly, image unevenness easily occurs.

On the other hand, when an extremely thin intermediate layer having a refractive index higher than those of the photosensitive layer and the surface layer is disposed between the photosensitive layer and the surface layer, the reflection intensity of the surface is substantially similar to that observed when only the photosensitive layer is disposed. When the surface layer disposed on the intermediate layer has a refractive index lower than that of the intermediate layer, reflection, at the interface of the surface layer and the intermediate layer, of the light that has passed through the surface layer is small. As a result, the variation in the total amount of the reflected light from the surface layer and the light that has been irradiated to the photoreceptor and reflected from the intermediate layer (hereinafter, simply referred to as "reflected light from the intermediate layer") in this case becomes smaller than the variation in the total amount of the reflected light in a case where the photoreceptor has a structure in which the surface layer is formed directly on the photosensitive layer. In addition, in the photoreceptor of the exemplary embodiment of the invention, since the intermediate layer has an extremely small thickness such as from 2 nm to 70 nm, intensity variation due to the interference of the reflected light from the photoreceptor becomes smaller than that observed when the thickness of the intermediate layer is larger than the above range.

Thus, in the exemplary embodiment of the invention, since the photoreceptor has a structure in which the intermediate layer having a thickness within the above-mentioned range and the surface layer are disposed in this order on the photosensitive layer and the refractive indices satisfy Inequality (1), the variation in the total amount of the reflected light from the photoreceptor is substantially equal to the variation in the amount of reflected light from a photoreceptor without an intermediate layer and a surface layer. Therefore, the variation in the amount of the light that has been irradiated to the photoreceptor and incident to the photosensitive layer, resulting from unevenness in the thickness of the surface layer, is suppressed, whereby generation of unevenness in image density is suppressed.

The refractive-index n1 of the photosensitive layer, the refractive index n2 of the intermediate layer, and the refractive index n3 of the surface layer satisfy Inequality (1). The difference between the refractive index n1 of the photosensitive layer and the refractive index n2 of the intermediate layer is preferably from 0.1 to 1.0 (or from about 0.1 to about 1.0), and more preferably from 0.3 to 0.7 (or from about 0.3 to about 0.7).

The difference between the refractive index n2 of the intermediate layer and the refractive index n3 of the surface layer is preferably from 0.01 to 0.7 (or from about 0.01 to about 0.7), and more preferably from 0.03 to 0.5 (or from about 0.03 to about 0.5).

The specific values of the refractive index n1 of the photosensitive layer, the refractive index n2 of the intermediate layer, and the refractive index n3 of the surface layer depend on the wavelength of the light irradiated to the photoreceptor. For example, when the wavelength of the light irradiated to the photoreceptor (for example, light irradiated when an electrostatic latent image is formed) is from 400 nm to 800 nm, the refractive index n2 of the intermediate layer may be from 1.8 to 2.3, and the refractive index n3 of the surface layer may be from 1.6 to 2.0.

The refractive index is measured as follows. Parameters, $\Delta$ and $\phi$, are measured at three incident angles in a wavelength range of from 1,500 nm to 200 nm with a spectroscopic ellipsometer (trade name: M-2000, manufactured by J.A. Woollam Co., Inc.). The parameters, $\Delta$ and $\phi$, represent a polarization state of light, are measured in an ellipsometry, and relate to the phase and amplitude of the s- and p-polarized components, respectively). The real number part n and the imaginary part k in the complex refractive index are obtained by an analysis with an analysis software WVAS32, and the layer thickness d is farther determined. A sample used as a specimen is obtained by forming only a layer to be measured on a Si substrate under the same condition as that employed for the preparation of the photoreceptor.

The intermediate layer and the surface layer each contain a Group 13 element and at least one of oxygen or nitrogen, and the refractive index of each layer may be adjusted to satisfy Inequality (1) by controlling at least one of (i) the types (combination) or (ii) the composition ratio of the elements contained in each of the intermediate layer and the surface layer (details will be described later). Therefore, the intermediate layer and the surface layer may be prepared such that the intermediate layer and the surface layer is different from each other in at least one of (i) the types or (ii) the composition ratio of the elements contained therein. For example, the photoreceptor may have a structure in which (i) the intermediate layer includes a first material containing a Group 13 element and at least one of oxygen or nitrogen, (ii) the surface layer includes a second material containing a Group 13 element and at least one of oxygen or nitrogen, and (iii) the first material and the second material have different compositional formulae. The intermediate layer may have an atomic composition that is different from that of the surface layer.

Since the surface layer and the intermediate layer each contain an oxide or nitride of a Group 13 element, the photoreceptor surface itself may be difficult to oxidize in an oxidizing atmosphere containing, for example, ozone or a nitrogen oxide generated by a charger in an image-forming apparatus. Therefore, deterioration of the photoreceptor due to oxidation may be prevented. Moreover, due to excellent mechanical durability and oxidation resistance of the photoreceptor, the properties required for a photoreceptor may be easily maintained at a high level over a long period of time. The surface of the photoreceptor, which is rubbed by a cleaning blade or the like, may have excellent abrasion resistance, and may be less likely to be damaged. Consequently, sufficient sensitivity may be easily obtained.

Further, since the refractive indices of the surface layer and the intermediate layer can be adjusted by controlling at least one of (i) the types or (ii) the composition ratio of the elements contained in each layer, adjustment of the refractive indices may be easy.

As described above, the thickness of the intermediate layer is from 2 nm to 70 nm (or about 2 nm to 70 nm). In relation to the wavelength $\lambda$ of the laser light to be used for exposure, the thickness of the intermediate layer may be $\lambda/10$ or smaller. When the thickness of the intermediate layer is $\lambda/10$ or smaller, the amount of the light reflected from the photosensitive layer having a lower refractive index than that of the intermediate layer is small. As a result, the total amount of the reflected light from the surface layer and the reflected light from intermediate layer may be smaller than the amount of reflected light from the surface layer observed when the intermediate layer is not provided. Thus, it is supposed that the variation in the amount of the incident light on the photosensitive layer due to unevenness in the thickness of the surface layer may be suppressed. The thickness of the intermediate layer is more preferably from 5 nm to 60 nm (or about 5 nm to about 60 nm), and particularly preferably from 10 nm to 50 nm.

Hereinafter, an example of a structure of an electrophotographic photoreceptor of an exemplary embodiment of the invention will be described in detail with reference to the drawings. FIG. 1 is a schematic sectional view illustrating an example of the layer structure of a photoreceptor of an exemplary embodiment of the invention, wherein reference numeral 1 represents a conductive substrate, reference numeral 2 represents a photosensitive layer, reference numeral 2A represents a charge generation layer, reference numeral 2B represents a charge transport layer, reference numeral 3 represents a surface layer, reference numeral 4 represents an undercoat layer, and reference numeral 5 represents an intermediate layer. The photoreceptor shown in FIG. 1 has a layer structure in which the undercoat layer 4, the charge generation layer 2A, the charge transport layer 2B, the intermediate layer 5, and the surface layer 3 are disposed on the conductive substrate 1 in this order. The photosensitive layer 2 has a two-layered structure having the charge generation layer 2A and the charge transport layer 2B.

Figure 2:
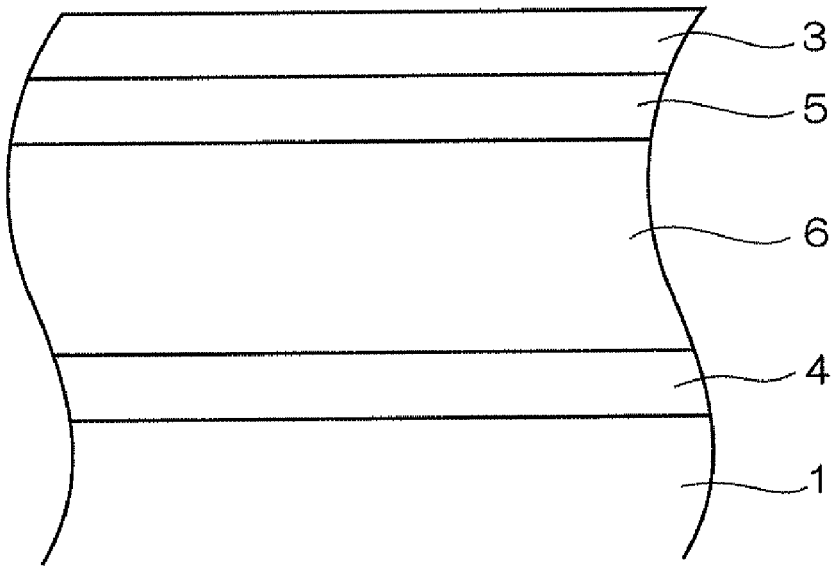
FIG. 2 is a schematic sectional view illustrating another example of the layer structure of a photoreceptor of an exemplary embodiment of the invention.

FIG. 2 is a schematic sectional view illustrating another example of a layer structure of a photoreceptor of an exemplary embodiment of the invention. In FIG. 2, reference numeral 6 represents a photosensitive layer, and the reference numerals represent the same layers as in FIG. 1.

The photoreceptor shown in FIG. 2 has a layer structure in which the undercoat layer 4, the photosensitive layer 6, the intermediate layer 5, and the surface layer 3 are disposed on the conductive substrate 1 in this order. The photosensitive layer 6 is a layer having integrated functions of both the charge generation layer 2A and the charge transport layer 2B shown in FIG. 1. The photosensitive layers 2 and 6 may be formed by at least one organic polymer or at least one inorganic material, or a combination at least one organic polymer and at least one inorganic material. Hereinafter, while the exemplary embodiment of the invention will be described in detail with reference to FIG. 1, it should be noted that the photosensitive layer 2 can be replaced by the photosensitive layer 6 shown in FIG. 2.

Intermediate Layer

In the exemplary embodiment of the invention, the intermediate layer 5 is disposed between the photosensitive layer 2 and the surface layer 3. The layer thickness of the intermediate layer is from 2 nm to 70 nm (or from about 2 nm to about 70 nm) and the refractive index of the intermediate layer satisfies Inequality (1).

The intermediate layer in the exemplary embodiment of the invention may contain a Group 13 element and at least one of oxygen or nitrogen. When the intermediate layer contains a Group 13 element and at least one of oxygen or nitrogen, mechanical stress caused by the difference in hardness and thermal expansion coefficient between the surface layer 3 and the photosensitive layer 2 may be reduced, and fatigue of the charge transport layer or the like caused by irradiation with plasma electrons, ions, or UV at the time of film formation may be prevented. In addition, electric properties and mechanical and chemical stability may be separated functionally, residual potential may be reduced, and cycle characteristics and resistance to environmental fluctuation may be improved.

In addition, the photosensitive layer 2 is less influenced by a corona discharge or short-wavelength light from various light sources such as ultraviolet rays when the photoreceptor is used in an image-forming apparatus. Without the intermediate layer, small cracks or defects would possibly be generated on the photosensitive layer surface by a stress that the charge transport layer intrinsically has from immediately after film formation in the case where the surface layer 3 is thickened or by mechanical stimuli applied cumulatively by a cleaner unit, paper or a transfer unit at the time of printing, which may deteriorate the charge transporting property or may cause uneven image density due to uneven charge transport. Such issues may be prevented by the intermediate layer.

As a result, an electrophotographic organic photoreceptor is provided which has excellent surface mechanical durability, oxidation resistance, and high sensitivity, and with which image defects due to deposition of discharge products are suppressed and quality (e.g., excellent uniformity of outputted images) is easily maintained at high level over time.

The intermediate layer 5 may be a layer containing a Group 13 element and at least one of nitrogen or oxygen. For example, the intermediate layer 5 may have a layer containing a compound of a Group 13 element and nitrogen and another layer containing a compound of a Group 13 element and oxygen. The intermediate layer 5 may have, for example, a multi-layer structure having a layer formed by a compound of Ga and nitrogen and a layer formed by a compound of Al and oxygen, a multi-layer structure having a layer formed by a compound of Ga and nitrogen and a layer formed by a compound of Ga and oxygen, or a multi-layer structure having a layer formed by a compound of Ga and oxygen and a layer formed by a compound of Ga and nitrogen.

In any case, the intermediate layer 5 of the exemplary embodiment of the invention may have a high degree of hardness and sufficient transparency. The intermediate layer 5 may have a thermal expansion coefficient that is intermediate between those of the surface layer 3 and the photosensitive layer 2 and may have sufficient adhesiveness to the photosensitive layer 2.

The Group 13 element contained in the intermediate layer 5 may be, for example, at least one element selected from B, Al, Ga, and In. The refractive index of the intermediate layer 5 may be freely adjusted to satisfy Inequality (1) by controlling at least one of the (i) types or (ii) the composition ratio of the elements—such as the at least one Group 13 element and the at least one of oxygen or nitrogen—contained in the intermediate layer 5. The combination of the contents of these atoms in the intermediate layer is not particularly limited. Among the above four elements. In has an absorption in the visible light wavelength region, while the other elements do not have an absorption in the visible light wavelength region. Thus, the wavelength region in which the intermediate layer 5 is responsive to light may be adjusted by appropriately selecting the Group 13 element(s) to be used. For example, the constituent elements in the intermediate layer 5 may be selected so that the intermediate layer 5 has as little absorption as possible at the exposure wavelength and/or the charge erasing wavelength used in the electrophotographic apparatus equipped with the photoreceptor.

In the exemplary embodiment of the invention, while the surface layer 3 and the intermediate layer 5 each contain a Group 13 element and at least one of nitrogen or oxygen, the surface layer 3 and the intermediate layer 5 are different from each other in at least one of the kind or the composition ratio of the elements contained in each layer. In view of obtaining the preferable characteristics described above, specifically, the following combinations may be adopted in connection with the kind of the elements contained in the surface layer 3:

the intermediate layer 5 may be formed by a nitride when the surface layer 3 is formed by an oxide; and when the surface layer 3 is formed by a nitride, the intermediate layer 5 may be formed by a different nitride of a Group 13 element from the nitride contained in the surface layer 3.

With regard to the composition ratio of the elements contained in the intermediate layer 5, when the surface layer 3 is formed by an oxide, the intermediate layer 5 may have a lower oxygen concentration than that in the surface layer 3. The exemplary embodiment of the invention also covers a structure in which the surface layer 3 and the intermediate layer 5 are different in visible absorption spectrum, conductivity, or the like due to only a slight difference in oxygen concentration such as a difference within a few %.

More specifically, the intermediate layer 5 may contain a compound of Al and nitrogen when the surface layer 3 contains a compound of Ga and nitrogen; and, when the surface layer 3 contains a compound of Ga and oxygen, the intermediate layer 5 may contain a compound of Ga and nitrogen or a compound of Al and nitrogen (which may contain oxygen additionally).

When the surface layer 3 contains a compound of Ga, oxygen and nitrogen, the intermediate layer 5 may contain a compound of such elements (however in this case, the composition ratios of the layers are different from each other).

When the intermediate layer 5 contains nitrogen, oxygen, and a Group 13 element, the ratio of the numbers of these atoms may be adjusted such that the refractive index of the intermediate layer 5 satisfies Inequality (1) as described above; the ratio of the total number of nitrogen atoms and oxygen atoms to the number of atoms of the Group 13 element may be in a range of from 0.5/1 to 3/1. When the ratio is within the above range, tetrahedrally-bonded regions and three-dimensionally-bonded regions may be increased, whereby sufficient chemical stability and hardness may be obtained.

When the intermediate layer 5 contains oxygen and a Group 13 element, the ratio of the number of oxygen atoms to the number of atoms of the Group 13 element may be in a range of from 0.1/1 to 3/1. When the ratio is within the above range, electric resistance sufficient for retention of a latent image may be achieved, and sufficient chemical stability and hardness may be obtained.

The composition ratio of the Group 13 element and the at least one of nitrogen or oxygen may be uniform with respect to the thickness direction of the intermediate layer 5. As an alternative, the nitrogen concentration may be increased in the thickness direction of the intermediate layer 5 toward the substrate side. The oxygen concentration may be decreased toward the substrate side. When both nitrogen and oxygen are contained in the intermediate layer 5, the distribution thereof may be such that the nitrogen concentration is decreased toward the substrate side and the oxygen concentration is increased toward the substrate side.

The intermediate layer 5 may be a layer containing only a Group 13 element and nitrogen and/or oxygen, or may contain at least one additional elements such as hydrogen as necessary. As an additional element, hydrogen may be contained. When hydrogen is contained, dangling bonds and structural defects generated by bonding among Ga, nitrogen and oxygen may be compensated for by hydrogen, whereby electrical, chemical, and mechanical stability may be enhanced and an intermediate layer having high hardness and transparency may be obtained whose surface has high water-repelling property and a low friction coefficient.

When the intermediate layer contains hydrogen, the content of hydrogen in the intermediate layer is preferably from 0.1 atomic % to 40 atomic %, and more preferably from 0.5 atomic % to 30 atomic %. When the content of hydrogen in the intermediate layer is within the above ranges, electrical stability, excellent mechanical properties, hardness, and chemical stability (in particular, water resistance) may be obtained.

The amount of hydrogen contained in the intermediate layer 5 is preferably from 0.1 atomic % to 50 atomic %, more preferably from 1 atomic % to 40 atomic %, with respect to the total amount of the main two elements ("Group 13 element and oxygen" or "Group 13 element and nitrogen") constituting the intermediate layer 5. When the intermediate layer 5 includes both nitrogen and oxygen, the above ratio is based on the total amount of the main three elements ("Group 13 element, nitrogen, and oxygen").

In the exemplary embodiment of the invention, the hydrogen content in the intermediate layer is a value determined by hydrogen forward scattering (HFS). The measurement method will be described below.

The intermediate layer may contain carbon additionally. The content of carbon may be 15 atomic % or less. When the content of carbon is 15 atomic % or less, sufficient chemical stability of the intermediate layer in the air may be obtained.

In the exemplary embodiment of the invention, the contents of the elements in the intermediate layer, such as the contents of the Group 13 element, nitrogen, oxygen, and carbon, and are values determined by Rutherford back-scattering (RBS). The distributions of the contents in the layer thickness direction are also determined by the Rutherford back-scattering (RBS). The measurement method will be described below.

It is not particularly limited whether the intermediate layer 5 is crystalline or noncrystalline. The intermediate layer may be microcrystalline, polycrystalline, or amorphous.

The intermediate layer 5 may be made of an amorphous material containing a microcrystal or a microcrystalline/polycrystalline material containing an amorphous material in consideration of stability or desired hardness, but is preferably amorphous in consideration of smoothness or friction of the surface of the intermediate layer. The crystallinity and amorphousness can be judged based on the presence or absence of points and lines in a diffraction image obtained by RHEED (reflection high-energy electron diffraction) measurement. The amorphousness can be judged based on the absence of a unique sharp peak at a diffraction angle in X-ray diffraction spectrum measurement.

In order to control the conductivity type and conductivity of the intermediate layer 5, various dopants may be added thereto. For example, one or more elements selected from Si, Ge, or Sn may be used to impart n-type conductivity to the intermediate layer 5, while one or more elements selected from Be, Mg, Ca, Zn, or Sr may be used to impart p-type conductivity to the intermediate layer 5. An undoped intermediate layer 5 is n-type in many cases, and an element that is used to impart p-type conductivity may be used in order to heighten the dark resistance.

In any of the cases in which the intermediate layer 5 of the exemplary embodiment of the invention is microcrystalline, polycrystalline or amorphous, the inner structure thereof tends to contain many bond defects, dislocation defects, crystal grain boundary defects, and the like. In order to inactivate these defects, hydrogen and/or a halogen element may be contained in the intermediate layer (e.g., a semiconductor layer). Since the hydrogen and/or halogen element in the intermediate layer is incorporated into the bond defects or the like to eliminate reactive sites and to provide electrical compensation, the traps related to diffusion and migration of carriers within the intermediate layer may be suppressed.

A method of forming the intermediate layer 5 will be explained in detail below. The intermediate layer 5 of the exemplary embodiment of the invention is, for example, obtained by the reaction of a compound containing gallium and a compound containing at least one of nitrogen or oxygen. The reaction may be carried out utilizing a plasma when the temperature of the substrate is from room temperature to 100° C. The compounds containing the above elements may be added simultaneously into the plasma, or the gallium-containing compound may be introduced at the downstream of a reactive, non-film-forming plasma containing the at least one of nitrogen or oxygen, so that the gallium-containing compound is degraded and reacts with the at least one of nitrogen or oxygen on the substrate. It is preferable to use the method for forming a surface layer described below since a continuous film formation is performed by the method.

When the intermediate layer 5 formed is an insulative layer, the thickness of the intermediate layer may be determined in consideration of a residual potential. When the intermediate layer 5 is a semiconductive layer, the volume resistivity thereof may be from $10^{+8}$ Ωcm to $10^{+13}$ Ωcm in view of not inhibiting latent image formation.

Surface Layer

The surface layer 3 of the exemplary embodiment of the invention is formed on the intermediate layer 5, and the refractive index thereof satisfies Inequality (1).

Moreover, the surface layer 3 of the exemplary embodiment of the invention may contain a Group 13 element and at least one of nitrogen or oxygen. When the surface layer 3 contains such elements, the surface layer may have high hardness and excellent transparency As in the case of the intermediate layer 5, incorporation of oxygen into the surface layer 3 may provide excellent oxidation resistance when exposed to oxygen in the air or to an oxidative atmosphere, and may cause less change in physical properties over time.

The surface layer 3 of the exemplary embodiment of the invention may contain a Group 13 element and at least one of nitrogen or oxygen, similarly to the intermediate layer 5. Therefore, the basic properties of the surface layer 3 are substantially as described above as the properties of the intermediate layer, except that factors such as the film-forming condition and the layer thickness are changed.

Examples of the compounds contained in the surface layer 3 include a compound containing a Group 13 element and oxygen, a compound containing a Group 13 element and nitrogen, and a compound containing a Group 13 element, oxygen and nitrogen.

When the surface layer 3 contains a Group 13 element and oxygen, the content of oxygen may be more than 15 atomic %. When the oxygen content is not more than 15 atomic %, the surface layer may be unstable in an oxygen-containing atmosphere, and hydroxyl groups may be generated by oxidation, whereby physical properties such as electrical and mechanical properties may change over time. Moreover, the electric resistance of the surface layer may be decreased, whereby the photoreceptor may not be able to retain an electrostatic latent image.

In view of ensuring sufficient oxidation resistance, the surface layer may have a higher oxygen content; however, a higher oxygen content may cause many of the molecular bonds between elements contained in the surface layer to have two-dimensional arrangements, so that the film may lack sufficient hardness and may be weak. When the surface layer 3 is formed only with a Group 13 element and oxygen, an oxygen content of 15 atomic % or less may cause lower electric resistance, so that the photoreceptor may not be able to retain an electrostatic latent image.

The oxygen content in the surface layer is more preferably 28 atomic % or more, and still more preferably 37 atomic % or more. The surface layer may contain nitrogen in an amount of 1 atomic % or more. From a practical viewpoint, the oxygen content may be 65 atomic % or less, and even in such a case, the nitrogen content in the surface layer may be 1 atomic % or more.

The contents of the Group 13 elements, oxygen, or the like at an outmost surface of the surface layer can be determined by XPS (X-ray photoelectronic spectrometry). For example, the contents measurement may be conducted with an XPS analyzer (trade name: JPS9010 MX, manufactured by JOEL LTD.) with irradiation with X-rays (MgKα line as the X-ray source) at 10 kV and 20 mA. In such a case, the photoelectronic measurement is performed at an interval of 1 eV, and the elemental contents of Ga, N and O are determined by measuring the 3d5/2 (for Ga) peak, 1 s (for N) peak, and 1 s (for O) peak, respectively, and calculating from the obtained peak areas and respective sensitivity factors. Before measurement, Ar-ion etching is performed at 500 V for approximately 10 sec.

When the surface layer 3 contains a Group 13 element and nitrogen, the thickness of the surface layer 3 may be 0.01 μm or more but less than 5 μm, and the centerline average roughness (Ra) of the surface after the formation of the surface layer 3 may be 0.1 μm or less.

When the centerline average roughness (Ra) of the surface is within the above range, cleaning defects caused by, for example, a blade or a brush in the cleaning step in the electrophotographic apparatus (image-forming apparatus) are suppressed, and damage to the underlying intermediate layer may be suppressed. In addition, peeling and cracking may be suppressed, whereby sufficient mechanical strength may be obtained.

The centerline average roughness (Ra) of the surface of the surface layer 3 is preferably 0.07 μm or less, and more preferably 0.05 μm or less.

The thickness of the surface layer 3 is preferably from 0.03 μm to 3 μm, and more preferably from 0.05 μm to 2 μm. When the thickness of the surface layer is within the above ranges, the surface layer may be hardly influenced by the photosensitive layer, and sufficient mechanical strength may be obtained. In addition, an increase in residual potential due to repetitive charging and exposure may be suppressed, an increase in internal mechanical stress to the photosensitive layer may be suppressed, and peeling and cracking may be suppressed.

The centerline average roughness (Ra) of the surface is determined as an average value obtained by measuring a photoreceptor in the axial direction at freely-selected 10 points with a surface roughness and contour measuring instrument (trade name: SURFCOM 550A, manufactured by Tokyo Seimitsu Co. Ltd.), under the conditions of a cutoff value of 75%, a measurement distance of 1.0 mm, and a scanning speed of 0.12 mm/sec.

The thickness of the surface layer is determined by a combination of a measurement with a stylus level difference analyzer (surface roughness measuring instrument, manufactured by Tokyo Seimitsu Co. Ltd.) and a cross sectional photograph of the surface layer (e.g., a semiconductor layer)

taken by a scanning electron microscope (trade name: S-400, manufactured by Hitachi, Ltd.).

The Group 13 element contained in the surface layer 3 may be specifically at least one element selected from B, Al, Ga, or In. The refractive index of the surface layer 3 may be adjusted to satisfy Inequality (1) by controlling at least one of (i) the types or (ii) the composition ratio of these elements and other contained elements such as oxygen or nitrogen. The combination of the contents of these atoms in the surface layer is not particularly limited. Among the four elements. In has an absorption in the visible light wavelength region, while the other elements do not have an absorption in the visible light wavelength region. Thus, the wavelength region in which the surface layer is responsive to light may be freely adjusted by appropriately selecting the Group 13 element(s) to be used. For example, when a semiconductor film is used as the surface layer of a photoreceptor, the element may be selected so that the surface layer has as little absorption as possible at the exposure wavelength and/or the charge erasing wavelength used in the electrophotographic apparatus equipped with the photoreceptor.

The ratio of the total number of nitrogen atoms and oxygen atoms to the number of atoms of the Group 13 element in the surface layer 3 may be in a range of from 0.5/1 to 3/1. When the ratio is within the above range, tetrahedrally-bonded regions may be increased, whereby sufficient chemical stability or hardness may be obtained.

The composition of the surface layer 3 may be uniform with respect to the thickness direction of the surface layer 3. As an alternative, when the surface layer 3 contains a Group 13 element and oxygen, the composition may have a gradient along the thickness direction of the surface layer 3, and the surface layer may have a multi-layer structure. The surface layer 3 may have a non-uniform distribution of nitrogen concentration along the thickness direction of the surface layer 3. The distribution may be such that the nitrogen concentration is increased toward the substrate side and the oxygen concentration is decreased toward the substrate side, or such that the nitrogen concentration is decreased toward the substrate side, and the oxygen concentration is increased toward the substrate side.

The surface layer 3 may be a layer containing only a Group 13 element and oxygen and/or nitrogen. When the surface layer contains only oxygen and a Group 13 element and the intermediate layer contains only oxygen and a Group 13 element, the interface between the surface layer and the intermediate layer may be discontinuous and the oxygen concentration in the intermediate layer may be lower than that in the surface layer. The surface layer 3 may contain at least one additional element, such as hydrogen, other than the Group 13 element, nitrogen and oxygen. As an additional element, hydrogen may be contained. When hydrogen is contained, dangling bonds and structural defects generated by bonding among Ga, nitrogen and oxygen may be compensated for by hydrogen, whereby electrical, chemical, and mechanical stability may be enhanced and a surface layer having high hardness and transparency may be obtained whose surface has high water-repelling property and a low friction coefficient.

When the surface layer 3 contains oxygen, the content of oxygen is preferably 15 atomic % or more, more preferably 28 atomic % or more, and still more preferably 37 atomic % or more.

When the oxygen content is within the above ranges, the surface layer may be stable even in an oxygen-containing atmosphere, whereby change in physical properties, such as electrical and mechanical properties, over time may be suppressed. In view of ensuring sufficient oxidation resistance, the surface layer may have a higher oxygen content; however, a higher oxygen content may cause many of the molecular bonds between elements contained in the surface layer to have two-dimensional arrangements, so that the film may lack sufficient hardness and may be weak. Thus the content of oxygen may be 65 atomic % or less from a practical viewpoint.

When the surface layer contains hydrogen, the content of hydrogen in the surface layer is preferably from 0.1 atomic % to 30 atomic %, and more preferably from 0.5 atomic % to 20 atomic %.

When the content of hydrogen is within the above ranges, electrical stability, excellent mechanical properties, hardness, and chemical stability (in particular, water resistance) may be obtained.

The amount of hydrogen contained in the surface layer is preferably from 0.1 atomic % to 50 atomic %, and more preferably from 1 atomic % to 40 atomic %, with respect to the total amount of the main two elements ("Group 13 element and oxygen" or "Group 13 element and nitrogen") constituting the surface layer. When the surface layer includes both nitrogen and oxygen, the above ratio is based on the total amount of the main three elements ("Group 13 element, nitrogen, and oxygen").

The hydrogen content is determined by hydrogen forward scattering (hereinafter, referred to as "HFS" in some cases) in the following manner (the content of hydrogen in the intermediate layer is also measured by the following manner).

For HFS, an accelerator (trade name: 3SDH PELLETRON, manufactured by NEC), an end station (trade name: RBS-400, manufactured by CE & A Co., Ltd.), and a system (trade name: 3S-R10) are used. The data are analyzed using HYPRA program (trade name, provided by CE & A Co., Ltd.).

HFS measuring condition is as follows:

$He^{++}$ ion beam energy: 2.275 eV

Detection angle: 30° with respect to the incident beam

In HFS measurement, a detector is positioned at an angle of 30° with respect to the $He^{++}$ ion beam, and a sample is placed at an angle of 75° with respect to the normal line, so that forward-scattered hydrogen signals are counted. The detector may be covered with a thin aluminum foil to remove He atoms that are scattered with hydrogen atoms. The count of hydrogen atoms obtained for a test sample and the count of hydrogen atoms obtained for a reference sample are respectively normalized with the respective stopping powers, and the obtained values are compared so that the hydrogen amount in the test sample is obtained. As reference samples, a sample obtained by ionically implanting H into Si, and white mica are used. White mica is known to have a hydrogen concentration of approximately 6.5 atomic %. The influence from H atoms absorbed on the outmost surface can be removed by subtracting the amount of H atoms adsorbed on a clean Si surface.

The amount of hydrogen in a layer can be estimated also from an infrared absorption spectrum measurement based on the signal intensity of the bond between the Group 13 element and hydrogen and/or the bond between N and H. When the hydrogen amount is measured using an infrared absorption spectrum, the layer may be formed on an infrared-transmitting substrate under the same conditions as in the case of preparing a photoreceptor, or the layer may be separated from a photoreceptor to form a KBr tablet for measurement. When the photosensitive layer is made of an organic photosensitive material, the photosensitive layer may be dissolved with an organic solvent, and a residue may be used for measurement.

When the photosensitive layer is made of an amorphous silicon, the surface of the photoreceptor may be scraped out for measurement or the entire photoreceptor may be peeled off for measurement.

The infrared absorption spectrum measurement is performed using a Fourier transform infrared absorption analyzer system B (trade name: SPECTRUM ONE, manufactured by Perkin Elmer) having an S/N of 30,000:1 and a resolution of 4 $cm^{-1}$. A sample in the form of a layer disposed on a silicon wafer of 10 mm×10 mm in size is placed on a test piece stage equipped with a beam condenser, and then measured. A silicon wafer without the sample layer is used as a reference.

For example, the half-value width of GaN absorption is defined as follows: a straight line connecting the absorption valleys at 1,100 $cm^{-1}$ and 800 $cm^{-1}$ is extrapolated toward the lower wave number side and the obtained straight line is used as a base line; a vertical line is drawn that descends from the peak of the GaN absorption peak to the base line, and the length of this vertical line is considered to be the total absorption intensity; and the width of the absorption peak in the horizontal direction at half the total intensity is assumed to be the half-value width of GaN absorption.

The surface layer may contain carbon, and the content of carbon in the surface layer may be 15 atomic % or less. When the content of carbon is 15 atomic % or less, sufficient chemical stability of the surface layer in air is obtained.

The contents of the elements, such as the Group 13 element, nitrogen, oxygen, and carbon, in the surface layer and the distributions thereof along the film thickness direction are determined by Rutherford back scattering (RBS) in the following manner (the measurements of the elements in the intermediate layer such as the Group 13 element are performed in the same manner).

For RBS, an accelerator (trade name: 3SDH PELLETRON, manufactured by NEC corporation), an end station (trade name: RBS-400, manufactured by CE & A Co. Ltd.), and a system (trade name: 3S-R10) are used. The data are analyzed using the HYPRA program (trade name, provided by CE & A Co., Ltd.).

As for RBS measuring conditions, the He++ ion beam energy is 2.275 eV, the detection angle is 160°, and the grazing angle with respect to incident beam is about 109°.

Specifically, the RBS measurement is performed in the following manner.

First, a $He^{++}$ ion beam is emitted such that the incident $He^{++}$ ion beam forms a right angle with a sample surface; a detector is placed at an angle of 160° with respect to the ion beam; and the signal of backscattered He atoms is measured. The composition ratio and the thickness of the layer are determined from the detected energy and signal intensity of the He atoms. The spectrum may be measured at two detection angles so as to improve the accuracy of the obtained composition ratio and layer thickness. The accuracy can be improved by conducting measurements at two detection angles that are different from each other in the resolution in the depth direction and/or backward scattering dynamics, and crosschecking the measurement results.

The number of He atoms scattered backward by target atoms depends only on three factors: 1) the atomic number of the target atoms, 2) the energy of the He atom before scattering, and 3) the scattering angle. The density is calculated from the measured composition, and the layer thickness is calculated from the calculated density. The error of the density is 20% or less.

Even when an intermediate layer and a surface layer are formed successively on a photosensitive layer as in the exemplary embodiment of the invention, the element composition of each of the surface layer and the intermediate layer can be determined using the above measurement method, without destroying a surface layer region.

The content of each element in the entire surface layer is determined by secondary electron mass spectrometry or XPS (X-ray photoelectronic spectrometry).

The surface layer 3 may be either crystalline or noncrystalline. The surface layer 3 may be microcrystalline, polycrystalline, or amorphous.

The surface layer may be an amorphous material containing a microcrystal or a microcrystal/polycrystal containing an amorphous material in consideration of stability and hardness, but is preferably amorphous in consideration of smoothness or friction of the surface of the surface layer. The crystallinity and amorphousness can be judged based on the presence or absence of points and lines in a diffraction image obtained by RHEED (reflection high-energy electron diffraction) measurement. The amorphousness can be judged based on the absence of a unique sharp peak at a diffraction angle in an X-ray diffraction spectrum measurement.

In order to control conductive type and conductivity of the surface layer 3, various dopants may be added thereto. For example, one or more elements selected from Si, Ge, or Sn may be used to impart n-type conductivity to the surface layer, while one or more elements selected from Be, Mg, Ca, Zn, or Sr may be used to impart p-type conductivity to the surface layer. An undoped surface layer 3 is n-type in many cases, and an element that is used to impart p-type conductivity may be used in order to heighten the dark resistance.

In any of the cases in which the surface layer 3 of the exemplary embodiment of the invention is microcrystalline, polycrystalline or amorphous, the inner structure thereof tends to contain many bond defects, dislocation defects, crystal grain boundary defects, and the like. In order to inactivate these defects, hydrogen and/or a halogen element may be contained in the surface layer. Since the hydrogen and/or halogen element in the surface layer may be incorporated into the bond defects or the like to eliminate reactive sites and to provide electrical compensation, the traps related to diffusion and migration of carriers within the surface layer may be suppressed.

In the following, favorable properties, other than the composition described above, of the surface layer 3 will be described briefly. The surface layer 3 may be amorphous or crystalline as described above. In view of improving adhesiveness to the photosensitive layer (or intermediate layer) and the sliding property of the photoreceptor surface, the surface layer 3 may be amorphous. The surface layer 3 may have a lower layer of the surface layer 3 that is microcrystalline and an upper layer that is amorphous, wherein "lower" means being at the photosensitive layer side and "upper" means being at the photoreceptor surface side.

The surface layer 3 may have such a configuration that a charge is injected into the surface layer 3 at the time of charging. In such a case, the charge may be trapped between the surface layer 3 and the photosensitive layer 2. Alternatively, the surface layer 3 may have such a configuration that a charge is trapped at the surface of the surface layer 3. When the photosensitive layer 2 is of a function-separated type as shown in FIG. 1 and a negative charge is provided to the surface layer 3 through injection of electrons to the surface layer 3, the surface-layer-side surface of the charge transport layer may function to trap the charge, or the intermediate layer 5 may function to block charge injection and to trap the charge. A similar configuration may be applied also when the photoreceptor is positively charged.

The surface layer 3 may also function as a charge injection-blocking layer or a charge-injection layer. In such a case, the surface layer 3 may function as a charge injection-blocking layer or a charge-injection layer by imparting n-type or p-type conductivity to the surface layer as described above.

When the surface layer 3 functions as a charge-injection layer, a charge is trapped at a surface (at a side nearer to the surface layer) of the intermediate layer 5 or at a surface (at a side nearer to the surface layer) of the photosensitive layer 2. When a negative charge is provided, an n-type surface layer 3 functions as a charge-injection layer while a p-type surface layer functions as a charge injection-blocking layer. When a positive charge is provided, an n-type surface layer 3 functions as a charge injection-blocking layer while a p-type surface layer functions as a charge-injection layer.

For retention of an electrostatic latent image, the surface layer may be a high-resistance i-type layer.

Formation of Surface Layer and Intermediate Layer

In the following, a method of forming a surface layer and an intermediate layer in the exemplary embodiment of the invention will be described. The surface layer and the intermediate layer may be formed by known gas-phase film-forming methods, such as a plasma CVD (chemical vapor deposition) method, an organometallic gas-phase growth method, a molecular beam epitaxy method, a vapor deposition method, or a sputtering method. Among these methods, the organometallic gas-phase growth method is preferable.

The surface layer and the intermediate layer of the exemplary embodiment of the invention may be formed on a photosensitive layer by activating, in an activation unit, a nitrogen-containing substance and/or an oxygen-containing substance to an energy state or excited state necessary for reaction to form active species, and reacting the activated species with an organometallic compound containing a Group 13 element that has not been activated.

By using the above method, a surface layer and an intermediate layer each having the properties described above may be formed without causing thermal damage to a photosensitive layer even when the photosensitive layer contains an organic material. When the surface layer and the intermediate layer are formed, the surface of the photosensitive layer may be cleaned with a plasma in advance.

The surface layer and the intermediate layer are usually formed by supplying a gas of an organometallic compound containing a Group 13 element and at least one of a gas of a nitrogen-containing substance or a gas of an oxygen-containing substance, or vaporized gases thereof, into a reaction chamber (film-forming chamber) in which a base material (a conductive substrate on which a photosensitive layer is formed) is placed while exhausting the reacted gas from the reaction chamber. The organometallic compound containing a Group 13 element may be introduced at a downstream side of the activation unit that activates the nitrogen-containing substance and/or oxygen-containing substance; in this case, the nitrogen-containing substance and/or the oxygen-containing substance, which is activated at the upstream side of the position at which the organometallic compound containing a Group 13 element is introduced, is combined with the organometallic compound containing a Group 13 element at a position located at the downstream side of the activation unit, so that the organometallic compound containing a Group 13 element, which has not been activated, reacts with the activated nitrogen-containing substance and/or the oxygen-containing substance react with it.

As to the formation of the surface layer and the intermediate layer of the exemplary embodiment of the invention, when the photosensitive layer of the photoreceptor contains an organic material such as an organic charge-generating substance or a binder resin, the highest temperature of a base material surface at the time of forming the intermediate layer on the photosensitive layer is preferably 100° C. or lower, more preferably 50° C. or lower, and still more preferably as close to room temperature as possible. When the highest temperature is 100° C. or lower, deformation of the base material or deterioration in physical properties caused by decomposition of the organic material contained in the photosensitive layer may be suppressed.

In the following, the method of forming a surface layer and an intermediate layer in an exemplary embodiment of the invention described above is more detailed, assuming, as an example, a case in which a surface layer and an intermediate layer of a photoreceptor is formed.

Figure 3A:
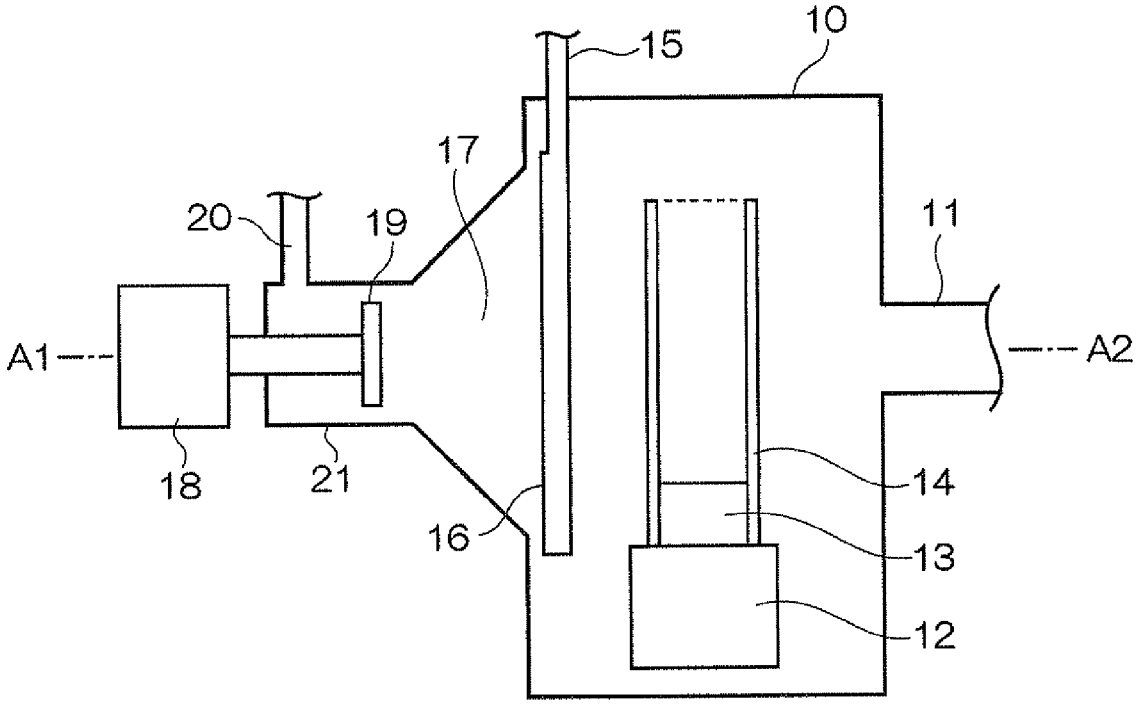
FIGS. 3A and 3B are schematic configuration diagrams illustrating an example of a film-forming apparatus used for forming an intermediate layer and a surface layer of a photoreceptor of an exemplary embodiment of the invention.
Figure 3B:
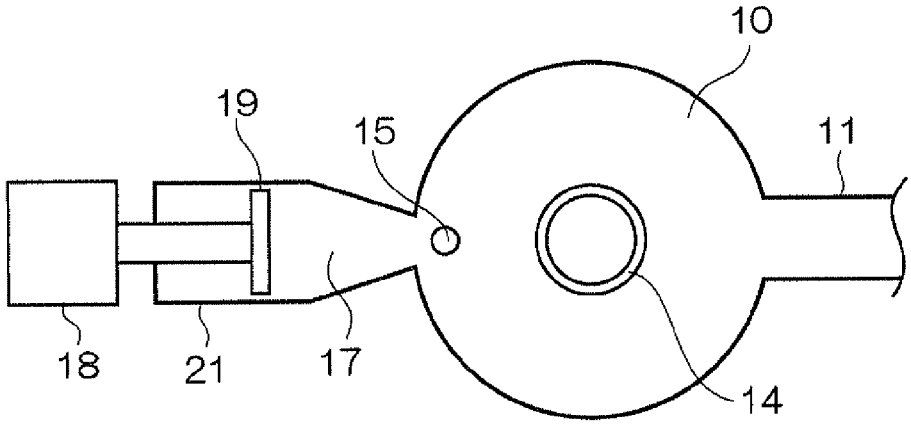

FIGS. 3A and 3B are schematic views illustrating an example of a film-forming apparatus used in the formation of an intermediate layer and a surface layer of a photoreceptor of an exemplary embodiment of the invention; FIG. 3A is a schematic sectional view illustrating a side view of the film-forming apparatus; and FIG. 3B is a schematic sectional view of the film-forming apparatus shown in FIG. 3A taken along the line A1-A2. In FIGS. 3A and 3B, reference numeral 10 represents a film-forming chamber, reference numeral 11 represents an exhaust vent, reference numeral 12 represents a substrate-rotating unit, reference numeral 13 represents a substrate holder, reference numeral 14 represents a base material, reference numeral 15 represents a gas inlet tube, reference numeral 16 represents a shower nozzle that has an opening through which a gas introduced through the gas inlet tube 15 is ejected, reference numeral 17 represents a plasma diffusion portion, reference numeral 18 represents a high-frequency power supply unit, reference numeral 19 represents a flat plate electrode, reference numeral 20 represents a gas-supply tube, and reference numeral 21 represents a high-frequency discharge tube unit.

In the film-forming apparatus shown in FIGS. 3A and 3B, the exhaust vent 11 is provided at one end of the film-forming chamber 10 and is connected to a vacuum exhaust device not shown in Figures. At a side of the film-forming chamber 10 that is opposite to the side at which the exhaust vent 11 is provided, a plasma-generating device including the high-frequency power supply unit 18, the flat plate electrode 19 and the high-frequency discharge tube unit 21 is disposed.

The plasma-generating device has the high-frequency discharge tube unit 21, the flat plate electrode 19 placed in the high-frequency discharge tube unit 21 and having a discharge face at the exhaust vent 11 side, and the high-frequency power supply unit 18 placed outside the high-frequency discharge tube unit 21 and connected to a face of the flat plate electrode 19 that is at the opposite side to the discharge face side. The gas-supply tube 20 for supplying a gas into the high-frequency discharge tube unit 21 is connected to the high-frequency discharge tube unit 21, and the other end of the gas-supply tube 20 is connected to a first gas supply source not shown in the Figures.

Figure 4:
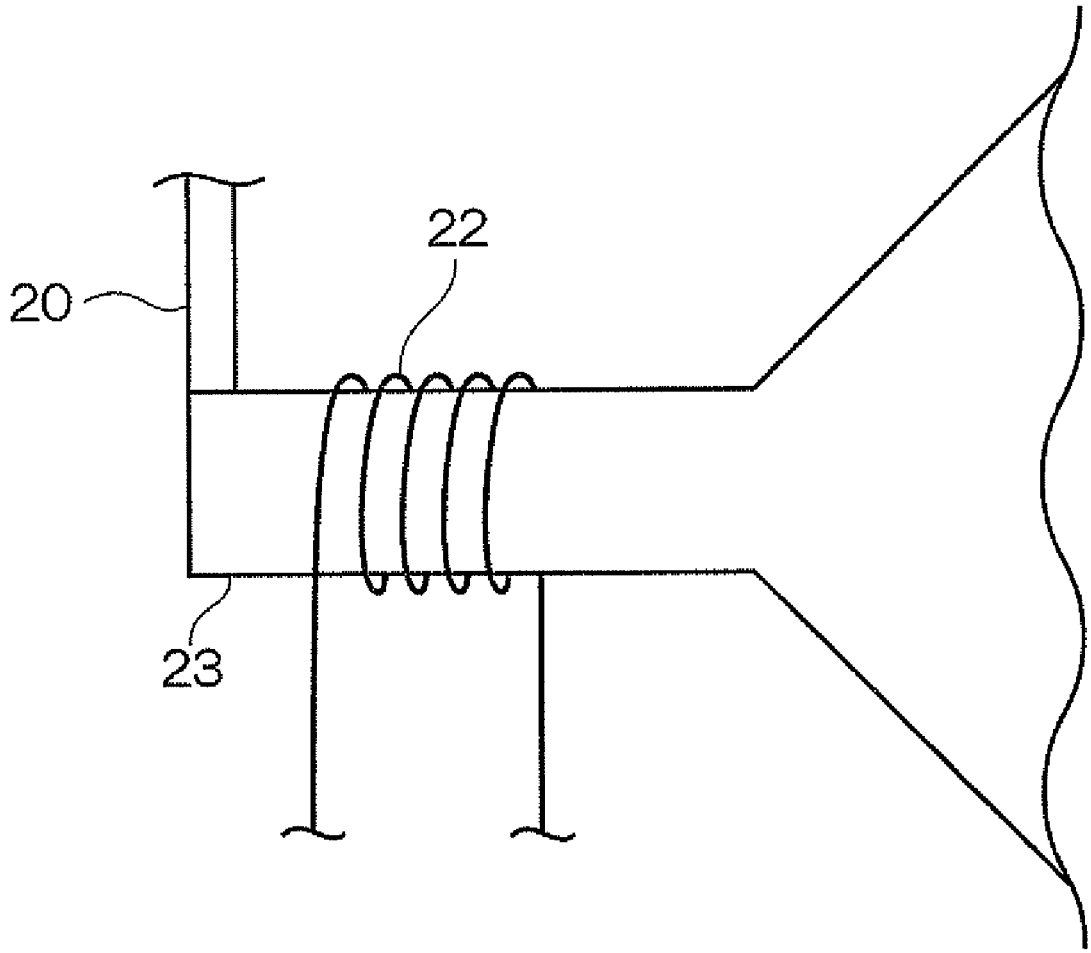
FIG. 4 is a schematic configuration diagram illustrating an example of a plasma-generating device that can be used in an exemplary embodiment of the invention.

The plasma-generating device installed in the film-forming apparatus shown in FIGS. 3A and 3B may be replaced with the plasma-generating device shown in FIG. 4. FIG. 4 is a schematic view illustrating another example of a plasma-generating device that can be used in the film-forming apparatus shown in FIGS. 3A and 3B, and is a side view of the plasma-generating device. In FIG. 4, reference numeral 22 represents a high-frequency coil, reference numeral 23 represents a quartz pipe, and reference numeral 20 represents the same member as the member represented by reference numeral 20 in FIGS. 3A and 3B. The plasma-generating device has a quartz pipe 23 and a high-frequency coil 22 disposed along the peripheral surface of the quartz pipe 23, and the other terminal of the quartz pipe 23 is connected to a film-forming chamber 10 (not shown in FIG. 4). The other end of the quartz pipe 23 is connected to the gas-supply tube 20 for supplying gas into the quartz pipe 23.

A rod-shaped shower nozzle 16 that is disposed substantially in parallel with the discharge face is connected to the discharge face side of the flat plate electrode 19. One end of the shower nozzle 16 is connected to a gas inlet tube 15. The gas inlet tube 15 is connected to a second gas supply source not shown in Figures disposed outside the film-forming chamber 10.

A substrate-rotating unit 12 is disposed in the film-forming chamber 10, and a cylindrical base material 14 is attached via a substrate holder 13 to the substrate-rotating unit 12 with the longitudinal direction of the shower nozzle being substantially in parallel with the axial direction of the base material 14. During film formation, the base material 14 is rotated in the circumferential direction by rotation of the substrate-rotating unit 12. The base material 14 may be a photoreceptor in which layer formation has been conducted up to formation of a photosensitive layer or a photoreceptor in which layer formation on a photosensitive layer has been conducted up to formation of an intermediate layer.

The surface layer and the intermediate layer (in the following, these layers are sometimes collectively referred to as "upper layers", and an "upper layer" means either the surface layer or the intermediate layer) are formed, for example, in the following manner. First, together with the introduction of $N_2$ gas, $H_2$ gas, He gas and $O_2$ gas into the high-frequency discharge tube unit 21 through the gas-supply tube 20, a radiofrequency wave at about 13.56 MHz is applied to the flat plate electrode 19 from the high-frequency power supply unit 18. A plasma diffusion portion 17 is formed that extends radially from the discharge face side of the flat plate electrode 19 toward the exhaust vent 11 side. The four gases introduced from the gas-supply tube 20 flow through the film-forming chamber from the flat plate electrode 19 side to the exhaust vent 11 side. The flat plate electrode 19 may have a structure in which the periphery of an electrode is covered with an earth shield.

Next, a trimethylgallium gas, which has been diluted with hydrogen as a carrier gas, is introduced into the film-forming chamber 10 via a gas inlet tube 15 and a shower nozzle 16 located at the downstream side (downstream with respect to the flow of the above four gases) of the flat plate electrode 19 as an activation unit, whereby a film containing gallium, nitrogen and oxygen that is not a single crystal is formed on the surface of the base material 14.

The temperature at the time of forming upper layers is not particularly limited. When an amorphous silicon photoreceptor is formed, the temperature of the surface of the cylindrical base material 14 at the time of forming upper layers may be from 50° C. to 350° C. When an organic photoreceptor is formed, the temperature of the surface of the cylindrical base material 14 at the time of forming upper layers may be from 20° C. to 100° C.

When an organic photoreceptor is formed, the temperature of the surface of the base material 14 during the formation of upper layers is preferably 100° C. or lower, more preferably 80° C. or lower, and still more preferably 50° C. or lower. Even when the temperature of the surface of the base material 14 is 100° C. or lower at the initiation of the layer formation, the photosensitive layer may be damaged by heat if the layer is heated to higher than 150° C. due to the influence of the plasma. Therefore, the surface temperature of the base material 14 may be adjusted in consideration of such an influence.

The surface temperature of the base material 14 may be controlled by a heating and/or cooling device (not shown in Figure), or it is also possible to let the surface temperature of the base material 14 naturally increase during discharge. In order to heat the base material 14, a heater may be provided at the outer surface side of the base material 14 or at the inner surface side of the base material 14. In order to cool the base material 14, a cooling gas or liquid may be circulated at the inner surface side of the base material 14.

In order to avoid an increase in the temperature of the base material 14 surface due to discharge, it is effective to control the flow of the high-energy gas supplied onto the surface of the base material 14. The control of the high-energy gas flow may involve adjustment of conditions such as the flow rate of gas, the discharge output, or the pressure so as to obtain a desired temperature.

In place of the trimethylgallium gas, an organometallic compound containing at least one of indium or aluminum, or a hydride such as diborane may be used as a gas containing a Group 13 element. It is also possible to use a mixture of two or more of these compounds.

For example, a film containing nitrogen and indium may be formed on the base material 14 by introducing trimethyl indium into the film-forming chamber 10 via the gas inlet tube 15 and the shower nozzle 16 in an early phase of the formation of the upper layers; the film containing nitrogen and indium absorbs ultraviolet rays which are generated during continuous film forming and which cause deterioration of the photosensitive layer, whereby damage to the photosensitive layer caused by the ultraviolet rays at film formation may be suppressed.

In order to control the conductive type of an upper layer, a dopant may be added thereto. For doping a dopant during film formation, gaseous $SiH_3$ or $SnH_4$ may be used for imparting n-type conductivity, while gaseous biscyclopentadienylmagnesium, dimethylcalcium, dimethylstrontium, dimethylzinc, diethylzinc, or the like may be used for imparting p-type conductivity. A known method such as a thermal diffusion method or an ion implantation method may be used for doping a dopant element into an upper layer.

Specifically, an upper layer having desired conductive type such as n-type or p-type may be obtained by introducing a gas containing at least one dopant element into the film-forming chamber 10 via the gas inlet tube 15 and the shower nozzle 16.

When an upper layer containing mainly a Group 13 atom, nitrogen atom and oxygen is formed by using a hydrogen-containing organometallic compound as a material for supplying the Group 13 element, an active hydrogen may be present in the film-forming chamber 10. The active hydrogen may be supplied from a hydrogen gas used as the carrier gas or from hydrogen atoms contained in the organometallic compound.

In the film-forming apparatus shown in FIGS. 3A and 3B, for example, when the position of introduction of a hydrogen gas into the film-forming apparatus and the position of introduction of a nitrogen or oxygen gas into the film-forming apparatus are different from each other, multiple plasma-generating devices may be arranged so that the activated state of the hydrogen gas and the activated state of the nitrogen or oxygen gas can be controlled independently. For simplification of the devices, it is possible to use, as a material for supplying a hydrogen gas and a nitrogen or oxygen gas, a gas containing both nitrogen and hydrogen atoms such as $NH_3$, a mixture of a nitrogen gas and a hydrogen gas, or a gas containing both oxygen and hydrogen such as $H_2O$, and to activate the gas by using a plasma.

In addition, when the carrier gas is a combination of a rare gas such as helium and hydrogen, hydrogen and the rare gas such as helium exert an etching effect on a film growing on the surface of the base material 14, whereby an amorphous compound of a Group 13 element and nitrogen and/or oxygen, which contains a reduced amount of hydrogen and which is equivalent to a compound formed by growth at high temperatures, is formed even at a low temperature of 100° C. or lower.

By the method described above, activated atoms of hydrogen, nitrogen, oxygen, and rare gas and the Group 13 atoms are brought to the vicinity of the surface of the base material 14, and the activated atoms of hydrogen or rare gas work to release hydrogen atoms from hydrocarbon groups (for example, a methyl group or an ethyl group) of the organometallic compound as molecular hydrogen. Thus, an upper layer is formed on the surface of the base material 14 at low temperature, and the formed upper layer contains less hydrogen and is a hard film in which the Group 13 element and at least one of nitrogen or oxygen form three-dimensional bonds.

Such a hard film is transparent. This is because the Ga atoms and the atoms of at least one of N or O form sp3 bonds, which are similar to the bonds formed by carbon atoms in diamond but dissimilar to the bonds formed by sp2-bonding carbon atoms contained in silicon carbide. In addition to the transparency and hardness of the film, the film surface has water-repellency and lower friction.

In the film-forming apparatus shown in FIGS. 3A and 3B, a high-frequency oscillator is used as a plasma-generating device. The plasma-generating device usable in the film-forming apparatus is not limited thereto, and examples thereof include a microwave oscillator, an apparatus using an electrocyclotron resonance system, and an apparatus using a helicon plasma system. The high-frequency oscillator may be either an induction oscillator or a capacitance oscillator. It is also possible to use two or more of these apparatuses in combination, or to use two or more apparatuses of the same kind. In order to prevent increase in the surface temperature of the base material 14 caused by plasma irradiation, the high-frequency oscillator may be used. For the prevention of the increase in the surface temperature of the base material 14, a device that prevents heat irradiation may be provided.

When two or more different plasma-generating apparatuses (plasma-generating devices) are used, they may start discharging simultaneously at the same pressure. There may be a difference in pressure between a discharge region and a film-forming region (a region at which the substrate is placed). The two or more plasma-generating apparatuses may be arranged in series with respect to the gas flow from the gas inlet to the gas outlet in the film-forming apparatus, or may be arranged such that all the apparatuses face the film-forming surface of a substrate.

For example, in the film-forming apparatus shown in FIGS. 3A and 3B, when two kinds of plasma-generating devices are arranged in series with respect to the gas flow, a plasma-generating device may be provided as a second plasma-generating device that causes discharge in the film-forming chamber 10 with the shower nozzle 16 serving as an electrode. In such a case, a high-frequency voltage is applied to the shower nozzle 16 (as an electrode) via the gas inlet tube 15 to cause discharge in the film-forming chamber 10. Instead of using the shower nozzle 16 as an electrode, a cylindrical electrode may be provided at a plasma-generating region between the base material 14 and the flat plate electrode 19 in the film-forming chamber 10 and the cylindrical electrode may be used to cause discharge in the film-forming chamber 10.

When two different kinds of plasma-generating devices are used under the same pressure, for example, a microwave oscillator and a high-frequency oscillator may be used. This combination of devices is effective in controlling film quality since the excitation energy of excited species can be changed largely by using the combination. The discharge may be conducted in the vicinity of the atmospheric pressure. When the discharge is conducted in the vicinity of the atmospheric pressure, the carrier gas for use may be He.

When forming the upper layers, other methods than the above-described methods may be used, such as common organometallic gas-phase growth methods and molecular beam epitaxy methods. Use of at least one of active nitrogen, active hydrogen, or active oxygen is effective for lowering the reaction temperature also in film formation by these methods. In such a case, $N_2$, $NH_3$, $NF_3$, $N_2H_4$, methyl hydrazine or the like may be used as a nitrogen source, and they may be in the form of gas themselves, vaporized from liquid, or incorporated into a carrier gas flow by bubbling with the carrier gas. As an oxygen source, oxygen, $H_2O$, CO, $CO_2$, NO, $N_2O$, or the like is usable.

The intermediate layer and surface layer in the exemplary embodiment of the invention may be formed consecutively by placing a base material 14 (this base material 14 has a photosensitive layer formed on a conductive substrate) in the film-forming chamber 10 and successively introducing into the film-forming chamber 10 mixed gases for the respective layers that have different compositions from each other. Alternatively, the formation of the intermediate layer and the surface layer may be conducted as follows: film formation up to the intermediate layer is conducted first, the obtained material is placed as a base material 14 in the film-forming chamber 10 again, and formation of the surface layer is conducted on the base material 14.

As for the film-forming conditions, when the discharge is performed by high-frequency discharging, the frequency may be from 10 kHz to 50 MHz in view of preparing a favorable quality film at low temperatures. The output depends on the size of the substrate, and may be in the range of from 0.01 $W/cm^2$ to 0.2 $W/cm^2$ with respect to the surface area of the substrate. The revolution rate of the substrate may be from 0.1 rpm to 500 rpm.

The condition for forming the intermediate layer and the condition for forming the surface layer may be the same as each other or different from each other. For example, the output for the intermediate layer formation may be set to a relatively small value in view of producing the intermediate layer at low temperatures, and the output for the surface layer formation may be set to a relatively high value.

The types and the composition ratio of the contained elements may be controlled in order to adjust the refractive index of each of the intermediate layer and the surface layer, and the control can be performed by adjusting, for example, the type and amount (ratio) of the gas introduced through the gas-supply tube 20 and the type and amount of the gas introduced through the gas inlet tube 15. The thickness of the intermediate layer and the thickness of the surface layer may be adjusted by controlling, for example, the amount and duration of gas introduction through the gas-supply tube 20, the amount and duration of gas introduction through the gas inlet tube 15, and discharge output.

The total thickness of the intermediate layer and the surface layer thus formed is preferably from 0.1 μm or more but less than 3 μm, and more preferably 0.2 μm or more but less than 2 μm. Moreover, the total thickness of the intermediate layer and the surface layer is preferably from 0.5% to 10%, and more preferably from 0.7% to 7%, of the thickness of the photosensitive layer described below. This is because, in general, when the photosensitive layer is thicker compared to the upper layers in a photoreceptor, the upper layers are less affected by distortion due to a stress.

When the total thickness of the intermediate layer and the surface layer is within the range of from 0.5% to 10% of the thickness of the photosensitive layer, the upper layers as a whole is less affected by a distortion in the photosensitive layer, whereby generation of cracking in the upper layers is suppressed; in addition, the actual residual potential of the photoreceptor is lower than the sum of the residual potentials of the individual layers. Therefore, a total thickness of the intermediate layer and the surface layer that is within the range of from 0.5% to 10% of the thickness of the photosensitive layer is preferable as the thickness of the upper layers in consideration of factors including durability.

Conductive Substrate and Photosensitive Layer

The photoreceptor of the exemplary embodiment of the present invention is not specifically limited as long as the photoreceptor has a layer structure in which a photosensitive layer, an intermediate layer and a surface layer are disposed on a conductive substrate in this order. If required, an undercoat layer or the like may be provided between the conductive substrate and the photosensitive layer. The photosensitive layer may have two or more layers and may be of a function-separated type. The photoreceptor of the exemplary embodiment of the present invention may be a so-called amorphous silicon photoreceptor in which a photosensitive layer contains silicon atoms.

When an amorphous silicon photoreceptor has the upper layers described in the exemplary embodiment of the invention on a photosensitive layer, image blurring under high humidity can be suppressed and durability and high image quality are both obtained. In particular, the photosensitive layer may be a so-called organic photoreceptor containing an organic material such as an organic photosensitive material.

In what follows, a favorable configuration of the photoreceptor of the exemplary embodiment of the invention is described assuming that the photoreceptor is an organic photoreceptor.

The organic polymer compound contained in the photosensitive layer may be thermoplastic or thermocuring, and may be formed by reaction of two kinds of molecules. In consideration of adjustment of hardness, expansion coefficient and elasticity and improvement in adhesiveness, the intermediate layer provided between the photosensitive layer and the surface layer may have physical properties intermediate between the properties of the surface layer and the properties of the photosensitive layer (the properties of the charge transport layer when the photosensitive layer is of a function-separated type). The intermediate layer may function as a layer that traps charges.

In the case of an organic photoreceptor, the photosensitive layer may be of a function-separated type having a charge generation layer and a charge transport layer as shown in FIG. 1 or of a functional-integrated type as shown in FIG. 2. In the case of a function-separated photosensitive layer, a charge generation layer may be positioned at the photoreceptor surface side or a charge transport layer may be positioned at the photoreceptor surface side.

When the upper layers are formed on the photosensitive layer by the above method, a layer that absorbs short-wavelength light such as ultraviolet rays may be formed on the surface of the photosensitive layer prior to the formation of the upper layers in order to prevent decomposition of the photosensitive layer by irradiation of short-wavelength electromagnetic waves other than heat. In order to protect the photosensitive layer from the irradiation of short-wavelength light, a layer having a small band gap may be formed first at the initial phase of the formation of upper layers. The composition of the layer having a small band gap formed on the photosensitive layer surface may be, when the layer contains In and Ga as a Group 13 element, $Ga_XIn_{(1-X)}N$ ($0 \leqq X \leqq 0.99$). The nitrogen and oxygen may be included under the same conditions as described above.

A layer containing an ultraviolet absorbent (for example, a layer containing an ultraviolet absorbent dispersed in a polymer resin formed by coating or the like) may be formed on the photosensitive layer surface, Formation of a protective layer on the photoreceptor surface prior to formation of the upper layers may inhibit the photosensitive layer from being affected by ultraviolet rays during formation of the upper layers or by corona discharge or short-wavelength light, such as ultraviolet rays, emitted from various light sources when the photoreceptor is used in an image-forming apparatus.

An example of the configuration of the photoreceptor of the exemplary embodiment of the invention is described below assuming that the photoreceptor is an amorphous silicon photoreceptor.

The amorphous silicon photoreceptor may be a photoreceptor for positive charging or negative charging. The photoreceptor may be a photoreceptor in which an undercoat layer for blocking charge injection and improving adhesiveness, a photoconductive layer, an intermediate layer and a surface layer are formed on a conductive substrate in this order.

The topmost layer of the photosensitive layer (layer at the surface layer side) may be a p-type amorphous silicon or an n-type amorphous silicon, and a charge injection-blocking layer such as a layer of $Si_XO_{1-X}$:H, $Si_XN_{1-X}$:H, $Si_XC_{1-X}$:H or amorphous carbon may be disposed between the photosensitive layer and the surface layer.

In the next place, the conductive substrate, the photosensitive layer, an optional undercoat layer, and an optional protective layer in the electrophotographic photoreceptor of an exemplary embodiment of the invention are described in detail assuming that an electrophotographic photoreceptor of an exemplary embodiment of the invention is an organic photoreceptor having a function-separated photosensitive layer.

Conductive Substrate

Examples of a conductive substrate include: a metal drum such as a drum made of aluminum, copper, iron, stainless steel, zinc, or nickel; a substrate obtained by depositing a metal such as aluminum, copper, gold, silver, platinum, palladium, titanium, nickel-chromium, stainless steel, or copper-indium on a base material such as a sheet, a paper, a plastic, or a glass; a substrate obtained by depositing a conductive metal compound such as indium oxide or tin oxide on the above base material; a substrate obtained by laminating a metal foil on the above base material; and a substrate obtained by dispersing carbon black, indium oxide, tin oxide-antimony oxide powder, metal powder, copper iodide, or the like in a binder resin and applying the dispersion to the above base material so as to impart conductivity. The shape of the conductive base substance may be any one of drum shape, sheet shape, or plate shape.

When a metallic pipe substrate is used as the conductive substrate, the surface of the metallic pipe substrate may be the surface of a raw pipe as it is. However, it is also possible to roughen the surface of the substrate by a surface treatment in advance. When a coherent light source such as a laser beam is used as an exposure light source, the above surface roughening prevents wood-grain-like unevenness in concentration which may occur in the photoreceptor due to the coherent light. Usable methods of surface treatment include specular cutting, etching, anodization, rough cutting, centerless grinding, sandblast, and wet honing.

In particular, in consideration of improvement of adhesiveness to the photosensitive layer and improvement of the film-forming property, an aluminum substrate whose surface has been anodized may be used as the conductive substrate.

A method of manufacturing a conductive substrate whose surface has been anodized is described below. First, as a substrate, pure aluminum or an aluminum alloy (for example, aluminum or an aluminum alloy having an alloy number of from 1000 to 1999, from 3000 to 3999, or from 6000 to 6999 defined in JIS H4080 (2006), which corresponds to ISO 6363-2 (1993)), is prepared. Next, anodization is performed. The anodization is performed in an acid bath of for example, chromic acid, sulfuric acid, oxalic acid, phosphoric acid, boric acid, or sulfamic acid. Treatment with a sulfuric acid bath is often used. The anodization can be performed, for example, substantially under the following condition:

sulfuric acid concentration: from 10 weight % to 20 weight %;

bath temperature: from 5° C. to 25° C.;

current density: from 1 A/dm$^2$ to 4 A/dm$^2$;

electrolysis voltage: from 5 V to 30 V; and treatment time: 5 minutes to 60 minutes.

The anodization is not limited to the above condition, and anodization in another manner may also be conducted.

The anodized film formed on the aluminum substrate in this manner is porous and highly insulative, and has a very unstable surface. Therefore, after forming the film, the physical characteristics values easily change over time. In order to prevent the change in physical characteristics values, the anodized film may be further subjected to sealing treatment. Example of methods of sealing include a method of immersing the anodized film in an aqueous solution containing nickel fluoride or nickel acetate, a method of immersing the anodized film in boiling water, and a method of treating with pressurized steam. Among these methods, the method of immersing in an aqueous solution containing nickel acetate is most frequently used.

On the surface of the anodized film that has been sealed in this manner, excessive metal salt and the like attached by the sealing treatment remain thereon. When excessive metal salt and the like remain on the anodized film of the substrate, not only the quality of the coating film formed on the anodized film is adversely affected, but also low resistant components generally tend to remain. Therefore, if the above substrate is used in a photoreceptor to form an image, the low resistant component may cause the development of scumming.

Therefore, following the sealing treatment, washing treatment of the anodized film is performed in order to remove the excess metal salt and the like attached during the sealing treatment. The washing treatment may involve washing the substrate with pure water in one step or washing the substrate with pure water in multiple steps. When the multi-step washing is applied, a cleanest possible (deionized) washing solution may be used in the last step. Furthermore, at any one step of the multi-step washing, a physical rubbing washing using a contact member such as a brush may be performed.

The thickness of the anodized film on the surface of the conductive substrate formed as above may be from 3 μm to 15 μm. On the anodized film, a barrier layer is present that follows the porous shaped top surface of the porous anodized film. The thickness of the barrier layer in a photoreceptor used in the exemplary embodiment of the invention may be from 1 nm to 100 nm. In the above manner, an anodized conductive substrate can be obtained.

In the conductive substrate obtained in this manner, the anodized film formed on the substrate by anodization has high carrier blocking property. Therefore, when a photoreceptor using this conductive substrate is installed in an image-forming apparatus and reverse development (a method of developing an exposed portion having a decreased (in terms of absolute value) electric potential) is performed using the apparatus, point defects (black dots and scumming) may be prevented. Moreover, current leak phenomenon from a contact electrification device, which often occurs at the time of contact electrification, may also be prevented. Moreover, by performing a sealing treatment on the anodized film, a change in the physical characteristics value over time after forming the anodized film may be prevented, and by washing the conductive substrate after the sealing treatment, the excess metal salt and the like attached to the surface of the conductive substrate during sealing treatment may be removed. Therefore, when an image-forming apparatus equipped with a photoreceptor produced by using this conductive substrate is used to form an image, the development of scumming may be sufficiently prevented.

Undercoat Layer

In the following, an undercoat layer will be explained. Examples of a material forming the undercoat layer include: a polymeric resin compound such as an acetal resin (for example, polyvinyl butyral), a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, or a melamine resin; an organometallic compound such as an organometallic compound containing zirconium, titanium, aluminum, manganese, a silicon atom or the like.

The undercoat layer may be formed by one of these compounds or by a mixture or polycondensate of two or more of these compounds. Among them, an organometallic compound containing zirconium or an organometallic compound containing silicon is preferable since such a compound enables lower residual potential, smaller variation in electric potential in various environments, and smaller change in electric potential over repetitive usage. The organometallic compound may be used singly, or two or more thereof may be used as a mixture. It is also possible to use a mixture of at least one organometallic compound and at least one resin, which may be selected from the above resins.

Examples of an organic silicon compound (organometallic compound containing a silicon atom) include vinyltrimethoxysilane, vinyltriethoxysilane, vinyltris(2-methoxyethoxy)silane, 3-methacryloxypropyltrimethoxysilane, 3-methacryloxypropyl-tris (2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2(aminoethyl)-3-aminopropylmethyldimethoxysilane, N,N-bis(2-hydroxyethyl)-3-aminopropyltriethoxysilane, N-phenyl-3-aminopropyltrimethoxysilane, and 3-chloropropyltrimethoxysilane. Among them, a silane coupling agent such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, or 3-chloropropyltrimethoxysilane is preferably used.

Examples of an organic zirconium compound (organometallic compound containing zirconium) include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of an organic titanium compound (organometallic compound containing titanium) include tetraisopropyl titanate, tetranormalbutyl titanate, butyl titanate dimer, tetra (2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of an organic aluminum compound (organometallic compound containing aluminum) include aluminum isopropylate, monobutoxyaluminum diisopropylate, aluminum butyrate, ethylacetoacetate aluminum diisopropylate, and aluminum tris(ethylacetoacetate).

A solvent used in a coating liquid for forming an undercoat layer may be a known organic solvent, and examples thereof include: an aromatic hydrocarbon solvent such as toluene or chlorobenzene; an aliphatic alcohol solvent such as methanol, ethanol, n-propanol, iso-propanol or n-butanol; a ketone solvent such as acetone, cyclohexanone, or 2-butanone; a halogenated aliphatic hydrocarbon solvent such as methylene chloride, chloroform, or ethylene chloride; a cyclic or linear ether solvent such as tetrahydrofuran, dioxane, ethylene glycol, diethylether; and an ester solvent such as methyl acetate, ethyl acetate, or n-butyl acetate. The solvent may be used singly, or a mixture of two or more thereof may be used. When two or more solvents are mixed, the solvents may be any solvents as long as the resultant mixed solvent can dissolve the binder resin.

The undercoat layer is formed by dispersing and mixing a coating agent for an undercoat layer and a solvent to form a coating liquid for forming an undercoat layer and applying the coating liquid to a surface of the conductive substrate. The method used for applying the coating liquid for forming an undercoat layer may be a general method such as a dip coating method, a ring coating method, a wire bar coating method, a spray coating method, a blade coating method, a knife coating method, or a curtain coating method. When the undercoat layer is formed, the thickness of the formed layer may be from 0.1 μm to 3 μm. When the thickness of the undercoat layer is within the above range, desensitization and increase in electric potential due to repetitive use may be prevented without excessively strengthening the electrical barrier.

Formation of the undercoat layer on the conductive substrate described above may make it possible to improve wettability when forming a layer on the undercoat layer by coating and also may make it possible for the undercoat layer to function sufficiently as an electrical blocking layer.

The surface roughness of the undercoat layer formed in the above manner may be adjusted to approximately a roughness of from 1/(4n) to 1 times the exposure laser wavelength λ to be used (where n represents the refractive index of the layer formed on the outer circumference of the undercoat layer). The surface roughness of the undercoat layer may be adjusted by adding resin particles into the coating liquid for forming an undercoat layer. When a photoreceptor having an undercoat layer whose surface roughness has been adjusted is used in an image-forming apparatus, interference fringes due to use of a laser source may be sufficiently prevented.

As the resin particles, silicone resin particles, crosslinked PMMA (poly(methyl methacrylate) resin particles, or the like may be used. The surface of the undercoat layer may be polished for adjusting the surface roughness. As the polishing method, buffing, sandblasting, wet honing, grinding treatment, or the like may be used. In a photoreceptor used in an image-forming apparatus utilizing positive charging, laser incident beams are absorbed in the vicinity of the top surface of the photoreceptor, and are further scattered in the photosensitive layer. Therefore, adjusting the surface roughness of the undercoat layer is not strongly requested.

In order to improve electric properties, environmental stability, and the quality of image, various additives may be added to the coating liquid for forming an undercoat layer. Examples of the additives include: an electron transport substance that includes a quinone-based compound such as chloranyl, bromoanil, or anthraquinone, a tetracyanoquinodimethane compound, a fluorenone compound such as 2,4,7-trinitrofluorenone or 2,4,5,7-tetranitro-9-fluorenone, an oxadiazol compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4 oxadiazole, a xanthone compound, a thiophene compound, and a diphenoquinone compound such as 3,3',5,5'-tetra-t-butyldiphenoquinone; an electron transport pigment such as a condensed polycyclic electron transport pigment or an azo electron transport pigment; and a known material such as a zirconium chelate compound, a titanium chelate compound, an aluminum chelate compound, a titanium alkoxide compound, an organic titanium compound, or a silane coupling agent.

Specific examples of the silane coupling agent include, but are not limited to, silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N, N-bis(β-hydroxyethyl)-γ-aminopropyltriethoxysilane, or γ-chloropropyltrimethoxysilane.

Specific examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphnate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl)titanate, titanium acetylacetonate, polytitanium acetylacetonate, titanium octyleneglycolate, titanium lactate anonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, ethylacetoacetate aluminum diisopropylate and aluminum tris(ethylacetoacetate).

The additive may be used singly, or a mixture or polycondensate of two or more thereof may be used.

The above coating liquid for forming the undercoat layer may contain at least one electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these materials, fluorenones, quinones, and benzene compounds having an electron-withdrawing substituent such as Cl, CN, or $NO_2$ are preferable. The use of an electron accepting material may enable improvement in the photosensitivity of the photosensitive layer, decrease in the residual potential, and suppression of reduction in the photosensitivity over repeated use. Therefore, when a toner image is formed by an image-forming apparatus equipped with a photoreceptor having an undercoat layer containing an electron accepting material, unevenness in concentration of the toner image may be sufficiently prevented.

Instead of using the above coating agent for an undercoat layer, a dispersion type coating agent for an undercoat layer described below may be used. By using the dispersion type coating agent, the electric resistance of the undercoat layer may be appropriately adjusted, and thereby accumulation of residual charge may be prevented; further, since the undercoat layer may be made thicker, the resistance of the photoreceptor against charge leakage may be improved, and leakage at the time of contact electrification may be prevented, in particular.

The dispersion type coating agent for an undercoat layer may be, for example, a coating agent in which a conductive material is dispersed in a binder resin, and examples of the conductive material include: powder of a metal such as aluminum, copper, nickel, or silver; a conductive metal oxide such as antimony oxide, indium oxide, tin oxide, or zinc oxide; and a conductive material such as carbon fiber, carbon black, or graphite powder. As the conductive metal oxide, metal oxide particles may be used which have an average primary particle diameter of 0.5 μm or less. When the average primary particle diameter is too large, a local electric-conducting path forms easily and current leakage easily occurs, which may result in fogging or leakage of large current from a charger. The undercoat layer may be adjusted to have an appropriate resistance in order to improve the leakage resistance. Therefore, the above metal oxide particles may have a powder resistivity of from about $10^2$ Ω·cm to about $10^{11}$ Ω·cm.

When the resistivity of the metal oxide particles is lower than the lower limit of the above range, sufficient leak resistance may not be obtained. When the resistivity is higher than the upper limit of the above range, the residual potential may increase. Therefore, metal oxide particles having a resistivity in the above range, such as particles of tin oxide, titanium oxide, or zinc oxide, may be used. It is possible to use a mixture of two or more kinds of metal oxide particles. Furthermore, by treating the surface of the metal oxide particles with a coupling agent, the powder resistivity of the metal oxide particles can be controlled. Examples of usable coupling agents include those usable in the coating liquid for forming an undercoat layer described above. It is possible to use a mixture of two or more coupling agents.

Any known method may be used for surface treatment on the metal oxide particles, for example dry methods and wet methods.

In a dry method, water adsorbed on the surface of the metal oxide particles is first removed by heat-drying. By removing the surface-adsorbed water, the coupling agent may be evenly adsorbed on the surface of the metal oxide particles. Then, while stirring the metal oxide particles by a mixer or the like having a large shearing force, the coupling agent as it is or a solution of the coupling agent in an organic solvent or water is dropped or sprayed with dry air or nitrogen gas, and thereby the particles are uniformly treated. When the coupling agent is dropped or sprayed, the treatment may be performed at a temperature of 50° C. or higher. After addition or spraying the coupling agent, the particles may be baked at a temperature of 100° C. or higher. The baking leads to hardening of the coupling agent, and the coupling agent tightly adheres to the metal oxide particles through a chemical reaction. The temperature and duration of the baking may be freely selected as long as desired electrophotographic characteristics are obtained.

In a wet method, the surface-adsorbed water on the metal oxide particles is first removed, similarly to the case of the dry method. The surface-adsorbed water may be removed, for example, by heat drying as in the dry method, by stirring the particles under heat in a solvent for surface treatment, or by azeotropy with a solvent. The metal oxide particles are then stirred in a solvent, and dispersed by using ultrasonic waves, a sandmill, an attritor, a ball mill, or the like. The coupling agent solution is then added thereinto, and stirred or dispersed. Then, the solvent is removed, whereby the particle surface is evenly treated. After removing the solvent, the mixture is baked additionally at 100° C. or higher. The temperature and duration of the baking may be freely selected as long as desired electrophotographic characteristics are obtained.

The amount of the surface-treating agent relative to the amount of the metal oxide particles may be such an amount that desired electrophotographic characteristics are obtained. The electrophotographic characteristics are influenced by the amount of the surface-treating agent adhering to the metal oxide particles after surface treatment. When the surface-treating agent is a silane-coupling agent, the adhesion amount thereof is determined on the basis of the Si intensity (which is given by the silane-coupling agent) and the intensity of the main metal element of the metal oxide as determined by fluorescent X-ray analysis. The Si intensity, as determined by fluorescent X-ray analysis, may be from $1.0\times10^{-5}$ times to $1.0\times10^{-3}$ times the intensity of the main metal element of the metal oxide used. When the intensity is below the range, image defects such as fogging may easily occur. When the intensity is above the range, decrease in image density may easily occur due to an increase in the residual potential.

Examples of the binder resin contained in the dispersion type coating agent for an undercoat layer include a known polymeric resin compound such as an acetal resin (for example, polyvinyl butyral), a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, or an urethane resin; a charge transport resin having a charge transport group; and a conductive resin such as polyaniline.

Among these resins, a resin that is insoluble in a coating solvent for a layer formed on the undercoat layer may be used. In particular, a phenol resin, a phenol-formaldehyde resin, a melamine resin, a urethane resin, an epoxy resin, and the like are preferable. The ratio of the metal oxide particles to the binder resin in the dispersion type coating liquid for forming an undercoat layer may be freely set within a range in which desired photoreceptor characteristics are obtained.

The method for dispersing, in a binder resin, the metal oxide particles that have been surface-treated by the method described above may be, for example, a method using a media disperser such as a ball mill, a vibration ball mill, an attritor, a sandmill, or a horizontal sandmill, or a method using a medialess disperser such as an agitator, an ultrasonic disperser, a roll mill, or a high pressure homogenizer. The high-pressure homogenizers may be, for example, a collision-type homogenizer in which dispersing is performed by a liquid-liquid collision or a liquid-wall collision under high pressure or a penetration-type homogenizer in which dispersing is performed by passing through fine channels under high pressure.

Formation of an undercoat layer using the dispersion type coating agent for an undercoat layer may be conducted in a manner similar to the formation of an undercoat layer using a coating agen for an undercoat layer described above.

Photosensitive Layer: Charge Transport Layer

In the following, the photosensitive layer is described by describing the charge transport layer and the charge generation layer in this order.

Examples of the charge transport material used in the charge transport layer include a hole transport material such as: an oxadiazole derivative such as 2,5-bis(p-diethylaminophenyl)-1,3,4-oxadiazole; a pyrazoline derivative such as 1,3,5-triphenyl-pyrazoline or 1-[pyridyl-(2)]-3-(p-diethylaminostyryl)-5-(p-diethylaminostyryl)pyrazoline; an aromatic tertiary amino compound such as triphenylamine, tri(p-methylphenyl)amine, N,N-bis(3,4-dimethylphenyl)biphenyl-4-amine, dibenzylaniline, or 9,9-dimethyl-N,N-di(p-tolyl) fluorenone-2-amine; an aromatic tertiary diamino compound such as N,N'-diphenyl-N,N'-bis(3-methylphenyl)-[1,1-biphenyl]-4,4'-diamine; a 1,2,4-triazine derivative such as 3-(4'dimethylaminophenyl)-5,6-di-(4'-methoxyphenyl)-1,2,4-triazine; a hydrazone derivative such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2-methyl-1-indolinylimino)methyl]carbazole, 4-(2-methyl-1-indolinylimino methyl)triphenylamine, 9-methyl-3-carbazolediphenylhydrazone, 1,1-di-(4,4'-methoxyphenyl) acrylaldehydediphenylhydrazone, or β,β-bis(methoxyphenyl) vinyldiphenylhydrazone; a quinazoline such as 2-phenyl-4-styryl-quinazoline; a benzofuran derivative such as 6-hydroxy-2,3-di(p-methoxyphenyl)-benzofuran; an α-stilbene derivative such as p-(2,2-diphenylvinyl)-N,N-diphenylaniline; an enamine derivative; a carbazole derivative such as N-ethylcarbazole; or poly-N-vinylcarbazole or a derivative thereof. Examples thereof further include a polymer having a group obtained from any of the above compounds in the main chain or a side chain. The charge transport material may be used singly, or two or more thereof may be used in combination.

Any resin may be used as the binder resin for use in the charge transport layer. However, the binder resin is preferably a resin having an appropriate strength and a compatibility with the charge transport material.

Examples of the binder resin include: various polycarbonate resins such as polycarbonate resins containing bisphenol A, bisphenol Z, bisphenol C, or bisphenol TP, and copolymers thereof; a polyarylate resin and copolymers thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, a styrene-alkyd resin; a poly-N-vinylcarbazole resin; a polyvinyl butyral resin; and a polyphenylene ether resin. The resin may be used singly, or a mixture of two or more thereof may be used.

The molecular weight of the binder resin for use in the charge transport layer may be selected properly according to the film-forming conditions such as the thickness of the photosensitive layer and the kind of solvent. Usually, the viscosity-average molecular weight of the binder resin is preferably in a range of from 3,000 to 300,000 and more preferably from 20,000 to 200,000.

The charge transport layer can be formed by coating a solution containing the charge transport material and the binder resin dissolved in a suitable solvent, followed by drying. Examples of the solvent to be used in the solution for forming a charge transport layer include an aromatic hydrocarbon such as benzene, toluene, or chlorobenzene; a ketone such as acetone or 2-butanone; a halogenated aliphatic hydrocarbon such as methylene chloride, chloroform, or ethylene chloride; a cyclic or straight-chain ether such as tetrahydrofuran, dioxane, ethylene glycol, or diethylether; and a mixed solvent thereof. The blending ratio (by weight) of the charge transport material to the binder resin may be in a range of from 10/1 to 1/5. In general, the thickness of the charge transport layer is preferably from 5 μm to 50 μm, and more preferably from 10 μm to 40 μm.

The charge transport layer and/or the charge generation layer described below may contain an additive such as an antioxidant, a photostabilizer, or a heat stabilizer, in view of preventing the degradation of the photoreceptor by heat, light, or the ozone or oxidative gases generated in the image-forming apparatus.

Examples of the antioxidant include a hindered phenol, a hindered amine, p-phenylenediamine, an arylalkane, hydroquinone, spirochromane, and spiroindanone, and derivatives thereof, an organic sulfur compound, and organic phosphorus compounds.

Specific examples of antioxidant compounds include phenolic antioxidants such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxyphenyl)propionate]-methane, 3,9-bis[2-[3-(3-t-butyl-4-hydroxy-5-methylphenyl)propionyloxy]-1,1-dimethylethyl]-2,4,8,10-tetraoxaspiro[5,5]undecane, stearyl 3-(3',5'-di-t-butyl-4'-hydroxyphenyl)propionate or the like.

Examples of hindered amines includes bis(2,2,6,6-tetramethyl-4-pyperidyl)sebacate, bis(1,2,2,6,6-pentamethyl-4-pyperidyl)sebacate, 1-[2-[3-(3,5-di-t-butyl-4-hydroxyphenyl) propionyloxy]ethyl]-4-[3-(3,5-di-t-butyl-4-hydroxyphenyl) propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diyl}{(2,2,6,6-tetramethyl-4-pyperidyl)imino}hexamethylene{(2,3,6,6-tetramethyl-4-pyperidyl)imino}], 2-(3,5-di-t-butyl-4-hydroxybenzyl)-2-n-butyl bismalonate acid bis(1,2,2,6,6-pentamethyl-4-pyperidyl), and N,N'-bis(3-aminopropyl) ethylenediamine-2,4-bis[N-butyl-N-(1,2,2,6,6-pentamethyl-4 piperidyl)amino]-6-chloro-1,3,5-triazine condensate.

Examples of organic sulfur antioxidants include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of organic phosphorus antioxidants include tris-nonylphenyl phosphite, triphenyl phosphite, and tris(2,4-di-t-butylphenyl)-phosphite.

The organic sulfur antioxidants and organic phosphorus antioxidants are called secondary antioxidants. A secondary antioxidant improves anti-oxidative effect synergistically when used in combination with a primary antioxidant such as a phenol- or amine-containing antioxidant.

Examples of photostabilizers include derivatives of benzophenone, benzotriazole, dithiocarbamate, and tetramethylpiperidine.

Examples of the benzophenone photostabilizers include 2-hydroxy-4-methoxybenzophenone, 2-hydroxy-4-octoxybenzophenone, and 2,2'-di-hydroxy-4-methoxybenzophenone.

Examples of the benzotriazole photostabilizers include 2-(2'-hydroxy-5'-methylphenyl)-benzotriazole, 2-[2'-hydroxy-3'-(3",4",5",6"-tetrahydrophthalimide-methyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl)-benzotriazole, and 2-(2'-hydroxy-3',5'-di-t-amylphenyl)-benzotriazole.

Examples of other photostabilizers include 2,4-di-t-butylphenyl-3',5'-di-t-butyl-4'-hydroxybenzoate, and nickel dibutyl-dithiocarbamate.

The charge transport layer may be formed by coating a solution containing a charge transport material and the binder resin dissolved in a suitable solvent, followed by drying. Examples of the solvent used for preparing the coating solution for forming a charge transport layer include: an aromatic hydrocarbon solvent such as benzene, toluene, or chlorobenzene; a ketone solvent such as acetone or 2-butanone; a halogenated aliphatic hydrocarbon solvent such as methylene chloride, chloroform, or ethylene chloride; a cyclic or straight-chain ether solvent such as tetrahydrofuran, dioxane, ethylene glycol, or diethylether; and a mixed solvent thereof.

To the coating solution for forming a charge transport layer, a trace amount of silicone oil may be added as a leveling agent for improving the smoothness of the coated film formed by coating.

The blending ratio of the charge transport material to the binder resin may be in a range of from 10/1 to 1/5 by weight. In general, the thickness of the charge transport layer is preferably from 5 μm to 50 μm, and more preferably from 10 μm to 30 μm.

The coating solution for forming a charge transport layer may be applied by a coating method, such as dip coating, ring coating, spray coating, bead coating, blade coating, roller coating, knife coating, or curtain coating, according to the shape and application of the photoreceptor. The drying may include drying to a dry-to-touch state at room temperature and subsequent heat-drying. The heat-drying may be conducted at a temperature range of from 30° C. to 200° C. for a period in a range of from 5 minutes to 2 hours.

Photosensitive Layer; Charge Generation Layer

The charge generation layer may be formed by depositing a charge generating material according to a vacuum deposition method or by coating a solution containing a charge generating material, an organic solvent, and a binder resin.

Examples of the charge generating material include selenium compounds such as amorphous selenium, crystalline selenium, selenium-tellurium alloys, and selenium-arsenic alloys; inorganic photoconductors such as selenium alloys, zinc oxide, and titanium oxide, and those obtained by sensitizing the above substances with a colorant; various phthalocyanine compounds such as metal free phthalocyanine, titanyl phthalocyanine, copper phthalocyanine, tin phthalocyanine, and gallium phthalocyanine; various organic pigments such as squarilium pigments, anthanthrone pigments, perylene pigments, azo pigments, anthraquinone pigments, pyrene pigments, pyrylium salts, and thiapyrylium salts; and dyes.

These organic pigments each generally have several crystal forms. In particular, phthalocyanine compounds are known to have many crystal forms including α-form and β-form. Any crystal form may be used as long as the pigment gives sensitivity and other characteristics suitable for the purpose.

Among the above charge generating materials, phthalocyanine compounds are preferable. When the photosensitive layer is irradiated with light, a phthalocyanine compound contained in the photosensitive layer absorbs a photon and generates a carrier. Due to a high quantum efficiency of the phthalocyanine compound, efficient carrier generation may occur based on the absorbed photon.

Among the above phthalocyanine compounds, phthalocyanines indicated in the following items (1) to (3) are more preferable as charge generating materials:

(1) crystalline hydroxygallium phthalocyanine having diffraction peaks at least at positions of 7.6°, 10.0°, 25.2°, and 28.0° in terms of Bragg angles (2θ±0.2°) of an X-ray diffraction spectrum obtained using a CuKα ray;

(2) crystalline chlorogallium phthalocyanine having diffraction peaks at least at positions of 7.3°, 16.5°, 25.4°, and 28.1° in terms of Bragg angles (2θ±0.2°) of an X-ray diffraction spectrum obtained using a CuKα ray; and (3) crystalline titanyl phthalocyanine having diffraction peaks at least at positions of 9.5°, 24.2°, and 27.3° in terms of Bragg angles (2θ±0.2°) of an X-ray diffraction spectrum obtained using a CuKα ray.

Due to high and stable photosensitivity of these phthalocyanine compounds, photoreceptors having photosensitive layers containing the phthalocyanine compounds are suitable as photoreceptors of color image-forming apparatuses which are required to have high-speed image forming ability and reproducibility over repeated cycles.

Although the peak intensity and the diffraction angle thereof may deviate slightly from the above value depending on the crystal shape and the measuring method, crystals having basically the same X-ray diffraction patterns are regarded as having the same crystal form.

Examples of the binder resins for use in the charge generation layer include polycarbonate resins, such as bisphenol-A polycarbonate resins and bisphenol-Z polycarbonate resins, and copolymers thereof, polyarylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicon-alkyd resins, phenol-formaldehyde resins, styrene-alkyd resins, and poly-N-vinylcarbazole.

The binder resin may be used singly, or two or more thereof may be used in combination. The blending ratio of the charge generating materials to the binder resin (charge generating material: binder resin) may be in a range of from 10/1 to 1/10 by weight. In general, the thickness of the charge generation layer is preferably from 0.01 μm to 5 μm, and more preferably from 0.05 μm to 2.0 μm.

For improving the sensitivity, reducing the residual potential, and reducing the fatigue over repeated use, the charge generation layer may contain at least one electron-accepting compound. Examples of the electron-accepting compound for use in the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these compounds, fluorenone compounds, quinone compounds and benzene compounds having an electron-withdrawing group such as Cl, CN, or $NO_2$ are particularly preferable.

The charge generating material may be dispersed in a resin, for example, by using a roll mill, a ball mill, a vibration ball mill, an attritor, a dyno mill, a sand mill, a colloid mill, or the like.

The solvent for use in the coating solution for forming a charge generation layer may be a known organic solvent, and examples thereof include an aromatic hydrocarbon solvent such as toluene or chlorobenzene; an aliphatic alcohol solvent such as methanol, ethanol, n-propanol, iso-propanol, or n-butanol; a ketone solvent such as acetone, cyclohexanone, or 2-butanone; a halogenated aliphatic hydrocarbon solvent such as methylene chloride, chloroform, or ethylene chloride; a cyclic or straight-chain ether solvent such as tetrahydrofuran, dioxane, ethylene glycol, or diethylether; and an ester solvent such as methyl acetate, ethyl acetate, or n-butyl acetate.

The solvent may be used singly, or a mixture of two or more solvents may be used. When a mixture of two or more solvents is used, the solvents may be any solvents as long as the resultant mixed solvent can dissolve the binder resin. However, when the photosensitive layer has a layer configuration in which a charge transport layer and a charge generation layer are formed in this order from the conductive substrate side and the charge generation layer is formed using an application method by which a lower layer is easily dissolved such as dip coating, a solvent that hardly dissolves the lower layer (for example, the charge transport layer) may be used. When the charge generation layer is formed by spray coating or ring coating, which is relatively less penetrative to the lower layer, the solvent may be selected from a wider range.

Process cartridge and Image-Forming Apparatus

Hereinafter, a process cartridge and an image-forming apparatus using the photoreceptor of the exemplary embodiment of the invention will be described.

The process cartridge of the exemplary embodiment of the invention is not particularly limited as long as the photoreceptor of the exemplary embodiment is used in the process cartridge. Specifically, the process cartridge may include integrally the photoreceptor of the exemplary embodiment of the invention and at least one selected from a charging unit, a developing unit, or a cleaning unit, and may have a structure that is attachable to and detachable from the main body of an image forming apparatus.

The image-forming apparatus of the exemplary embodiment of the invention is not particularly limited as long as a photoreceptor of the exemplary embodiment of the invention is used in the image-forming apparatus. Specifically, the image-forming apparatus of the exemplary embodiment of the invention may include the photoreceptor of the exemplary embodiment of the invention, a charging unit that charges a photoreceptor surface, an exposure unit (an electrostatic latent image forming unit) that forms an electrostatic latent image by photoirradiating the photoreceptor surface that has been charged by the charging unit, a developing unit that forms a toner image by developing the electrostatic latent image with a toner-containing developer, and a transfer unit that transfers the toner image onto a recording medium. The image-forming apparatus of the exemplary embodiment of the invention may be a so-called tandem apparatus having multiple photoreceptors corresponding to the toners for the respective colors. In this case, all the photoreceptors be may be photoreceptors of the exemplary embodiment of the invention. The transfer of the toner image may be conducted in an intermediate transfer manner in which an intermediate transfer medium is used.

Figure 5:
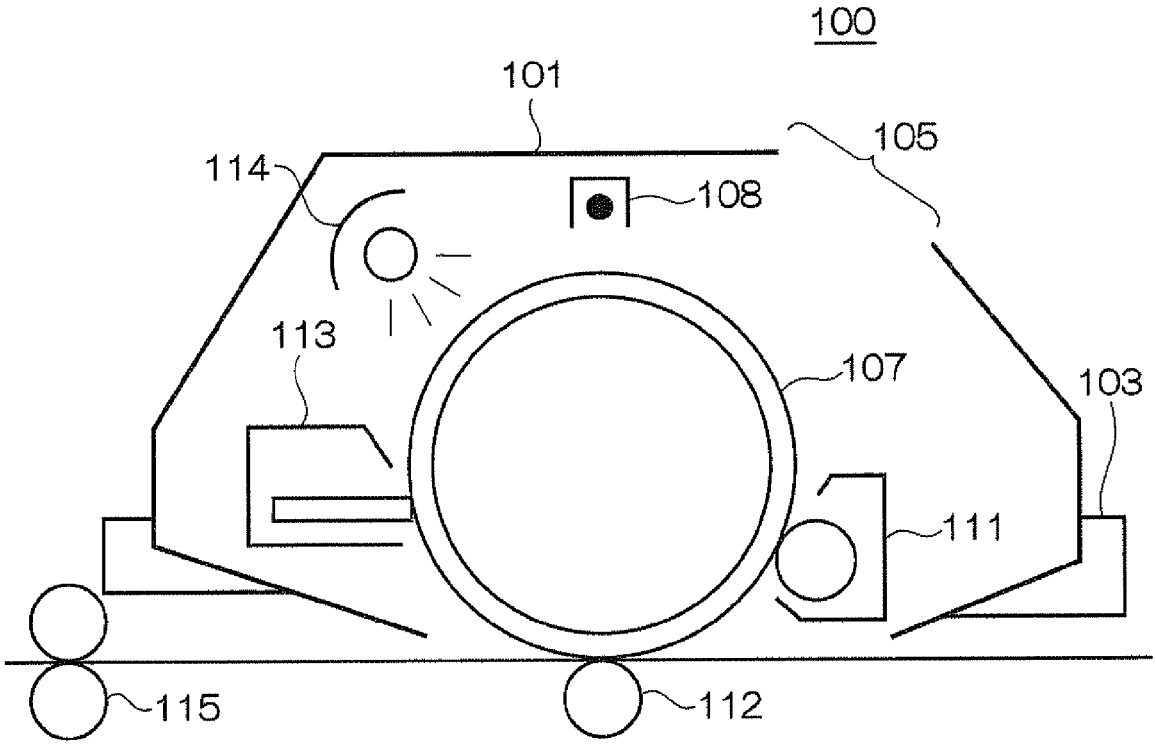
FIG. 5 is a schematic configuration diagram illustrating an example of a process cartridge of an exemplary embodiment of the invention.

FIG. 5 is a schematic view illustrating a basic configuration of an example of a process cartridge of the exemplary embodiment of the invention. The process cartridge 100 includes an electrophotographic photoreceptor 107, a charging unit 108, a developing unit 111, a cleaning unit 113, an opening 105 for exposure and an charge erasing unit 114, which are combined and integrated by a case 101 and a fixing rail 103. The process cartridge 100 is detachable from and attachable to the main body of an image-forming apparatus containing a transfer unit 112, a fixing unit 115, and other components not shown in the figure. The process cartridge 100 constitutes an image-forming apparatus together with the main body of the image-forming apparatus (electrophotographic apparatus).

Figure 6:
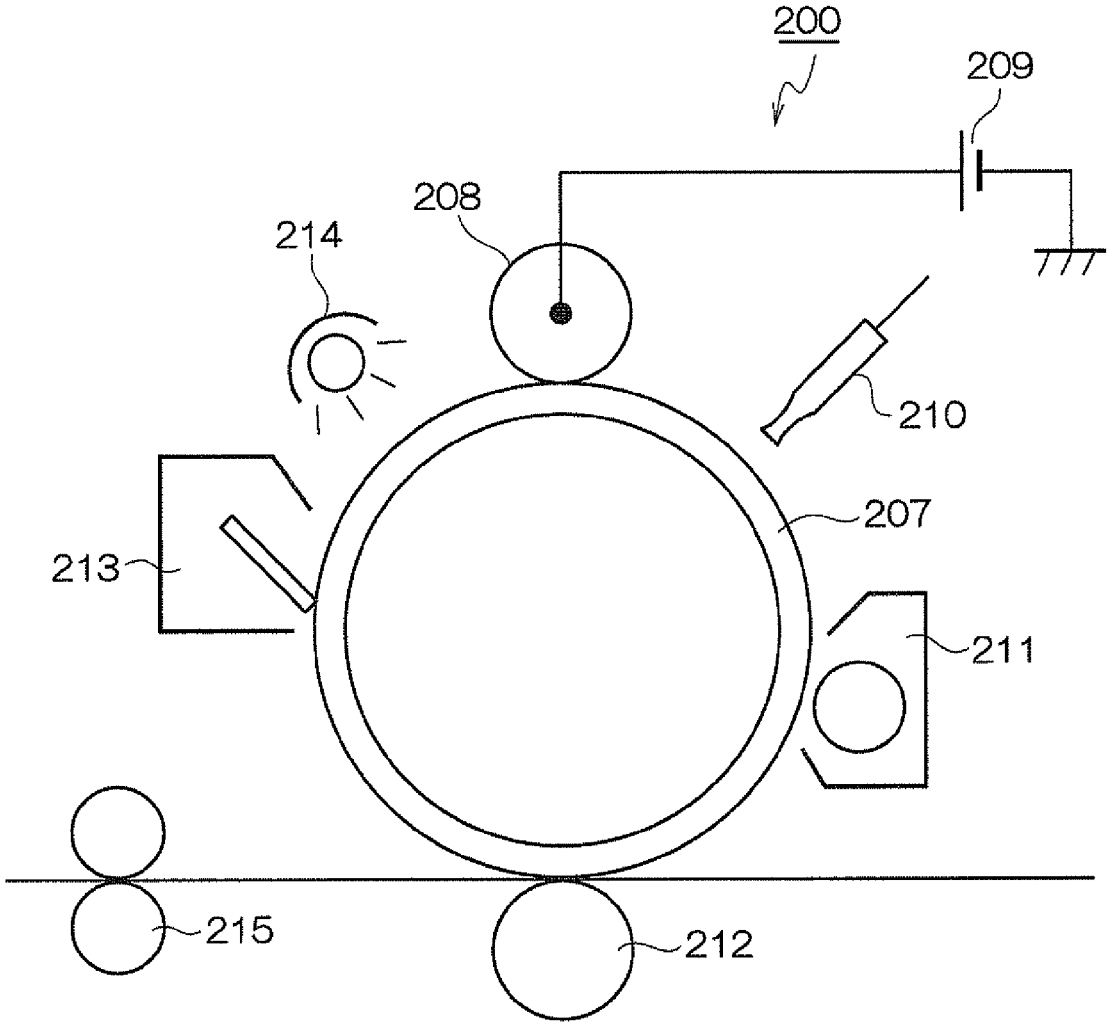
FIG. 6 is a schematic configuration diagram illustrating an example of an image-forming apparatus of an exemplary embodiment of the invention.

FIG. 6 is a schematic view illustrating the basic configuration of an example of an image-forming apparatus of the exemplary embodiment of invention. The image-forming apparatus 200 shown in FIG. 6 has an electrophotographic photoreceptor 207, a charging unit 208 that charges the electrophotographic photoreceptor 207 in a contact manner, a power source 209 connected to the charging unit 208, an exposing unit 210 that exposes to light the electrophotographic photoreceptor 207 that has been charged by the charging unit 208, a developing unit 211 that develops the region exposed to light by the exposing unit 210, a transferring unit 212 that transfers the image on the electrophotographic photoreceptor 207 that has been formed by the developing unit 211, a cleaning unit 213, a charge erasing unit 214, and a fixing unit 215.

The cleaning unit for the photoreceptor in the process cartridge or in the image-forming apparatus of the exemplary embodiment of the invention is not particularly limited, and may be a cleaning blade.

EXAMPLES

Hereinafter, the invention will be described specifically with reference to Examples. However, it should be understood that the invention is not limited to these Examples.

Example 1

Preparation of Electrophotographic Photoreceptor

According to the following procedure, an undercoat layer, a charge generation layer, and a charge transport layer are formed on a substrate Al in this order to give an organic photoreceptor.

Formation of Undercoat Layer

One hundred parts by weight of zinc oxide (average particle diameter: 70 nm) are mixed with 500 parts by weight of tetrahydrofuran under stirring. To the mixture, 1.25 parts by weight of a silane coupling agent (trade name: KBM603, manufactured by Shin-Etsu Chemical Co., Ltd.) are added and stirred for 2 hours. Subsequently, baking is conducted to obtain a zinc oxide pigment whose surface is treated with the silane-coupling agent.

60 parts by weight of the surface-treated zinc oxide, 0.6 part by weight of alizarin, 13.5 parts by weight of a curing agent (blocked isocyanate, trade name: SUMIDUR 3175, manufactured by Sumika Bayer Urethane Co., Ltd.), and 15 parts by weight of a butyral resin (trade name: S-LEC BM-1, manufactured by Sekisui Chemical Co. Ltd.) are dissolved in 85 parts by weight of methyl ethyl ketone to form a solution. 38 parts by weight of the obtained solution and twenty-five parts by weight of methyl ethyl ketone are mixed, and the obtained mixture liquid is subjected to a dispersion treatment for 2 hours in a sand mill using glass beads having a diameter of 1 mm, whereby a dispersion liquid is obtained. 0.005 parts by weight of dioctyltin dilaurate as a catalyst and 4.0 parts by weight of silicone resin particles (trade name: TOSPEARL 145, manufactured by GE Toshiba Silicones Co., Ltd.) are added to the obtained dispersion liquid to provide a coating liquid for forming an undercoat layer. The obtained coating solution is applied by a dip coating method to an aluminum substrate, followed by drying and hardening at 170° C. for 40 min, whereby an undercoat layer having a thickness of 5 μm is formed.

Formation of Charge Generation Layer 1 part by weight of chlorogallium phthalocyanine as a charge generating material, 1 part by weight of polyvinylbutyral (trade name: S-LEC BM-S, manufactured by Sekisui Chemical Co., Ltd.), and 100 parts by weight of n-butyl acetate are mixed to form a mixture. The mixture is subjected to a dispersion treatment for 1 hour in a paint shaker using the glass beads, whereby a dispersion liquid for forming a charge generation layer is obtained.

The obtained dispersion liquid is applied onto the undercoat layer by a dip coating method and dried at a temperature of 100° C. for 10 minutes, whereby a charge generation layer having a thickness of 0.15 μm is obtained.

Formation of Charge Transport Layer

Further, 2 parts by weight of the compound represented by the following Structural Formula (1) and 3 parts by weight of the polymer compound whose repeating unit is represented by the following Structural Formula (2) (viscosity-average molecular weight: 39,000) are added to 20 parts by weight of chlorobenzene and dissolved, whereby a coating liquid for forming a charge transport layer is obtained.

Structural Formula (1)

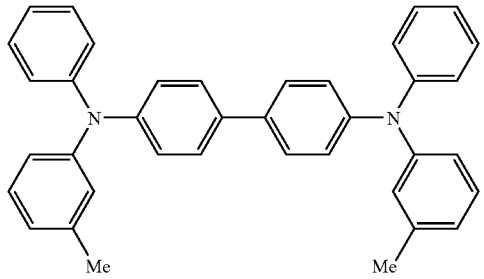

-continued

Structural Formula (2)

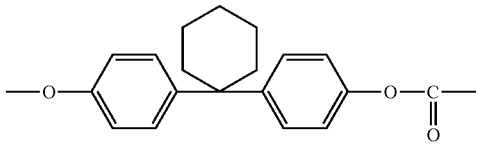

The obtained coating liquid is applied onto the charge generation layer by dip coating and then heated at 110° C. for 40 minutes to form a charge transport layer having a thickness of 20 μm, whereby an organic photoreceptor in which an undercoat layer, a charge generation layer and a charge transport layer are formed on an Al substrate in this order (hereinafter, sometimes referred to as "non-coated photoreceptor") is obtained.

Formation of Intermediate Layer

An intermediate layer is formed on the non-coated photoreceptor using an film-forming apparatus having the configuration shown in FIGS. 3A and 3B.

First, the non-coated photoreceptor is mounted on a substrate holder 13 in the film-forming chamber 10 of the film-forming apparatus, and then the interior of the film-forming chamber 10 is evacuated to a pressure of about 0.1 Pa through the exhaust vent 11.

Thereafter, a mixed gas of nitrogen gas and $H_2$ gas in a ratio of 1:10 is introduced from a gas-supply tube 20 into a high-frequency discharge tube unit 21 in which a flat plate electrode 19 having a diameter of 50 mm is disposed, at a flow rate of 300 sccm (nitrogen gas: 500 sccm, hydrogen gas: 500 sccm). Then, electric discharge is performed from a flat plate electrode 19 by applying a radio frequency wave at 13.65 MHz with matching by a tuner set to have an output of 100 W, using a high-frequency power supply unit 18 and a matching circuit (not shown in FIGS. 3A and 3B). The reflected wave at this time is 0 W.

Subsequently, a mixed gas containing a hydrogen gas as a carrier gas and a trimethyl gallium gas is introduced from a shower nozzle 16 into a plasma diffusion portion 17 in the film-forming chamber 10 via a gas inlet tube 15 at a trimethyl gallium gas flow rate of 0.2 sccm. At this time, the reaction pressure in the film-forming chamber 10 determined by a Baratron vacuum gauge is 40 Pa.

In this state, film formation is performed for 10 minutes while rotating the non-coated photoreceptor at a speed of 100 rpm to form a GaN film having a thickness of 15 μm, whereby an organic photoreceptor having an intermediate layer formed on the surface of the charge transport layer is obtained.

For the measurement of the film thickness, another experiment is conducted under the same film-forming conditions as described above. Specifically, film formation is performed for 2 hours on an Si substrate (10 mm×5 mm) which is partially masked with KAPTON tape (trade name, manufactured by Du Pont-Toray Co., Ltd; having a film thickness of 50 μm) under the same conditions as described above, and then the film thickness of the obtained reference film is determined by level difference measurement using a SURFCOM 113A (trade name, manufactured by Tokyo Seimitsu Co., Ltd.). As a result, the level difference is 180 nm. The thickness of the intermediate layer is calculated by multiplying this thickness of the reference film by the ratio of the film-forming time for the intermediate layer to the film-forming time for the reference film.

In Examples 7 to 10 described below, when oxygen is introduced, oxygen gas diluted to 1% by He gas is mixed with nitrogen gas, and then introduced to form a film containing Ga, N, O, and H. The oxygen gas flow rate is 0.5 sccm (Example 7 and Example 8) or 0.7 sccm Example 9 and Example 10

Formation of Surface Layer

Subsequent to the formation of the intermediate layer, He gas, hydrogen gas, and oxygen gas diluted to 4% by He gas are mixed in a mixing device (not shown in drawings), and the mixture gas is introduced from a gas supply tube 20 towards an flat plate electrode 19 having a length of 350 mm at a flow rate of about 352 sccm (He gas: 150 sccm, hydrogen: 200 sccm, oxygen: 2 sccm). Electric discharge is performed from the flat plate electrode 19 by setting an output of 13.65 MHz radio frequency wave to 80 W with matching by a tuner, using a high-frequency power supply unit 18 and a matching circuit (not shown in the drawings). The reflected wave at discharge is 0 W.

Subsequently, trimethyl gallium gas is introduced from a shower nozzle 16 into a film-forming chamber 10 through a gas inlet tube 15 at a trimethyl gallium gas flow rate of 1.0 sccm. At this time, the reaction pressure in the film-forming chamber 10 determined by a Baratron vacuum gauge is 30 Pa.

Film formation is conducted for 60 minutes while rotating the photoreceptor having the intermediate layer at a speed of 100 rpm, so that a GaO film having a thickness of 0.5 μm and containing hydrogen is formed, whereby a photoreceptor Al having a surface layer formed on the surface of the intermediate layer is obtained. When the surface layer is formed, the non-coated photoreceptor is not heated. For the measurement of the film thickness, a reference sample in which only the surface layer is formed on an Si substrate is formed under the same conditions as described above, and then the film thickness of the reference sample is obtained by the same level difference measurement method as that used in the case of the intermediate layer. At this time, the color of a temperature-recording tape (TEMP-PLATE P/N101, manufactured by Wahl), which has been attached to a surface of the substrate prior to the film formation for the purpose of monitoring the temperature at the time of film formation, is observed after film formation, and the recorded temperature is found to be 42° C.

Analysis and Evaluation of Intermediate Layer and Surface Layer

A sample intermediate layer is formed on a Si substrate under the same conditions as those used for the formation of an intermediate layer on the non-coated photoreceptor surface described above, and the infrared ray absorption spectrum of the sample intermediate layer is measured. As a result, there are peaks corresponding to Ga—H, Ga—N and N—H bonds. The result indicates that gallium, nitrogen and hydrogen are contained in the intermediate layer.

The composition of the sample intermediate layer is determined by Rutherford back scattering and hydrogen forward scattering. The measurement results indicate that the composition ratio of gallium, nitrogen, and hydrogen is 1:0.5:0.8, and that the nitrogen content is lower than the stoichiometric ratio of Ga to N (1:1).

The surface layer is analyzed and evaluated in a similar manner. As a result, Ga—O bond is confirmed by infrared absorption spectrum, showing that the composition ratio of Ga, O, and H is 1:1.3:0.4, and that the oxygen content is lower than the stoichiometry ratio of Ga to O (1:1.5).

The diffraction image obtained by RHEED (reflection high-energy electron diffraction) measurement includes a blurred ring in a halo pattern, indicating that the layer is an amorphous microcrystalline layer.

Evaluation of Property of Photoreceptor

Initial Contact Angle

The initial contact angle is measured in an environment at 23° C. and 55% RH by dropping pure water on a sample film formed on a Si substrate immediately after film formation, using a contact angle meter (trade name: CA-X roll-type, manufactured by Kyowa Interface Science Co., Ltd.). The average value obtained by three repeated measurements at different positions is used as the contact angle.

Properties of light interference are evaluated by measuring a reflectance spectrum.

Evaluation of Variation in Reflection Intensity

The spectral intensity spectrum of the reflected light from the photoreceptor surface irradiated with white light (wavelength: 400 to 800 nm) is measured by using a line spectrometer.

Figure 7A:
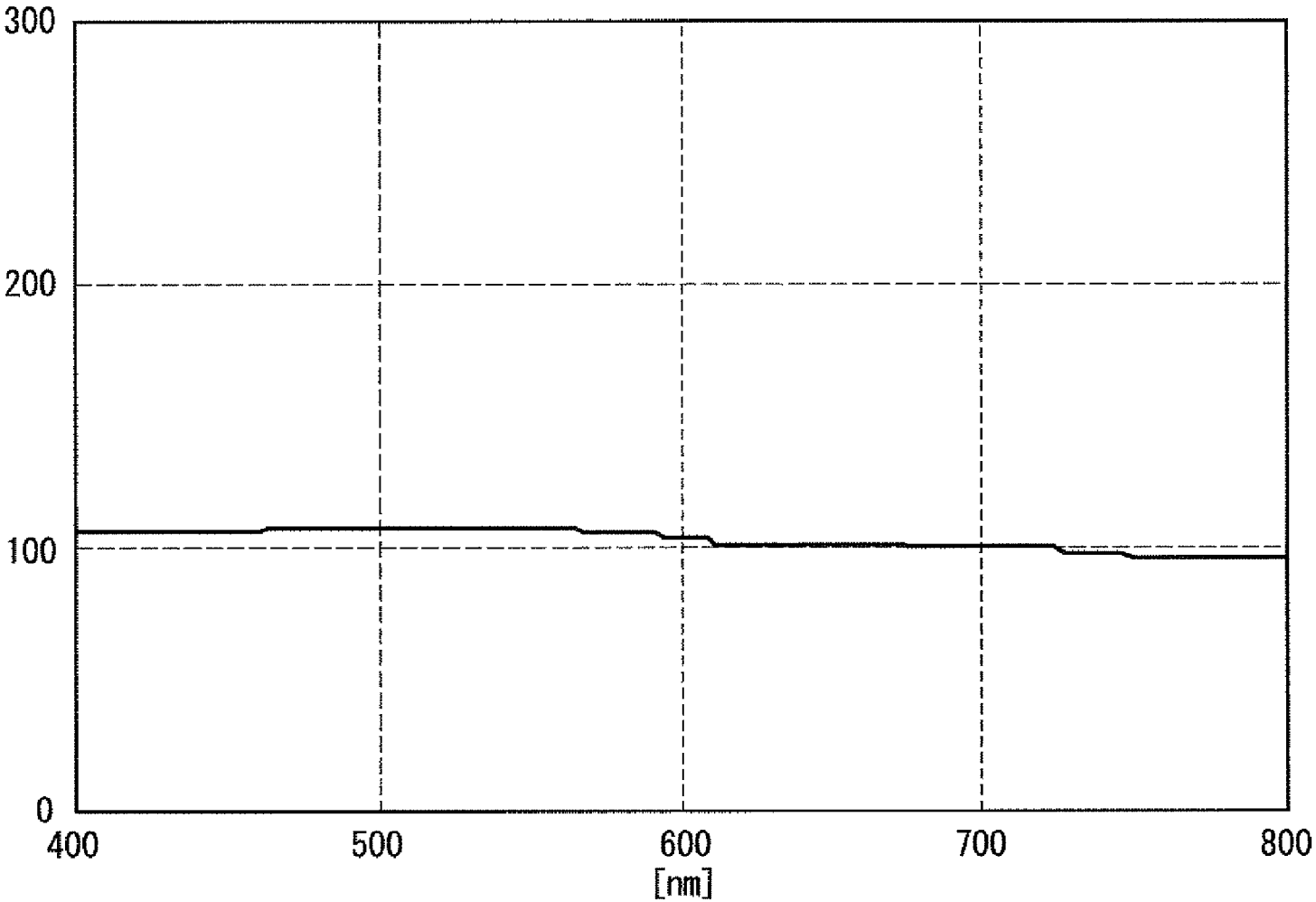
FIGS. 7A and 7B are graphs illustrating measurement results of Examples.
Figure 7B:
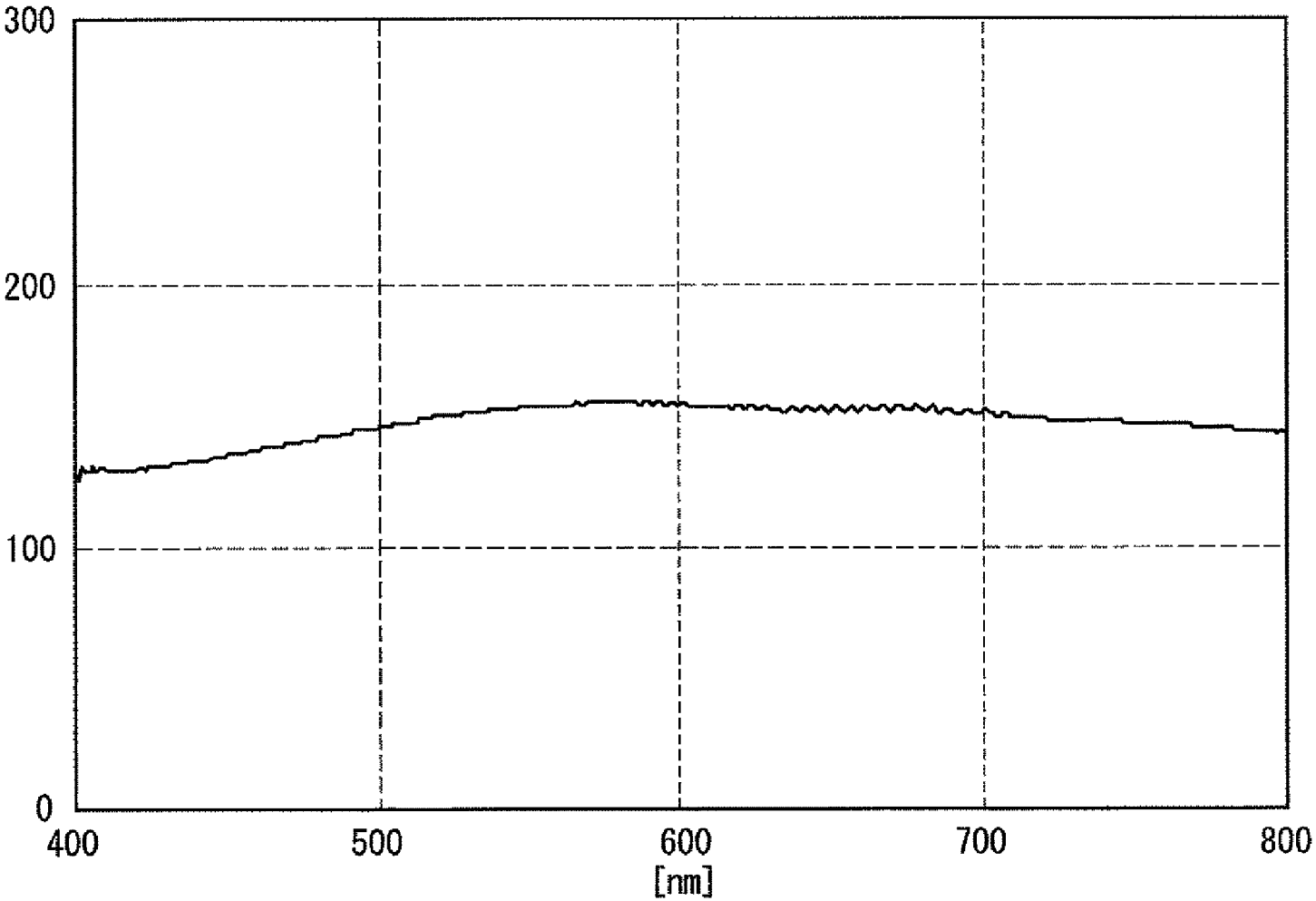

The spectral reflection intensity spectrum of a standard organic photoreceptor (non-coated photoreceptor) is measured first, and the spectrometer is calibrated by setting the value for reflection intensity at each wavelength to 100. The results are shown in FIG. 7A. Subsequently, the spectral reflection intensity spectrum of a photoreceptor in which only the intermediate layer is formed on the non-coated photoreceptor is measured. The results are shown in FIG. 7B. The value 100 on the vertical axis indicates the same reflectance as that of the non-coated photoreceptor, and the value 200 on the vertical axis indicates a reflectance that is twice the reflectivity of the non-coated photoreceptor.

Figure 7C:
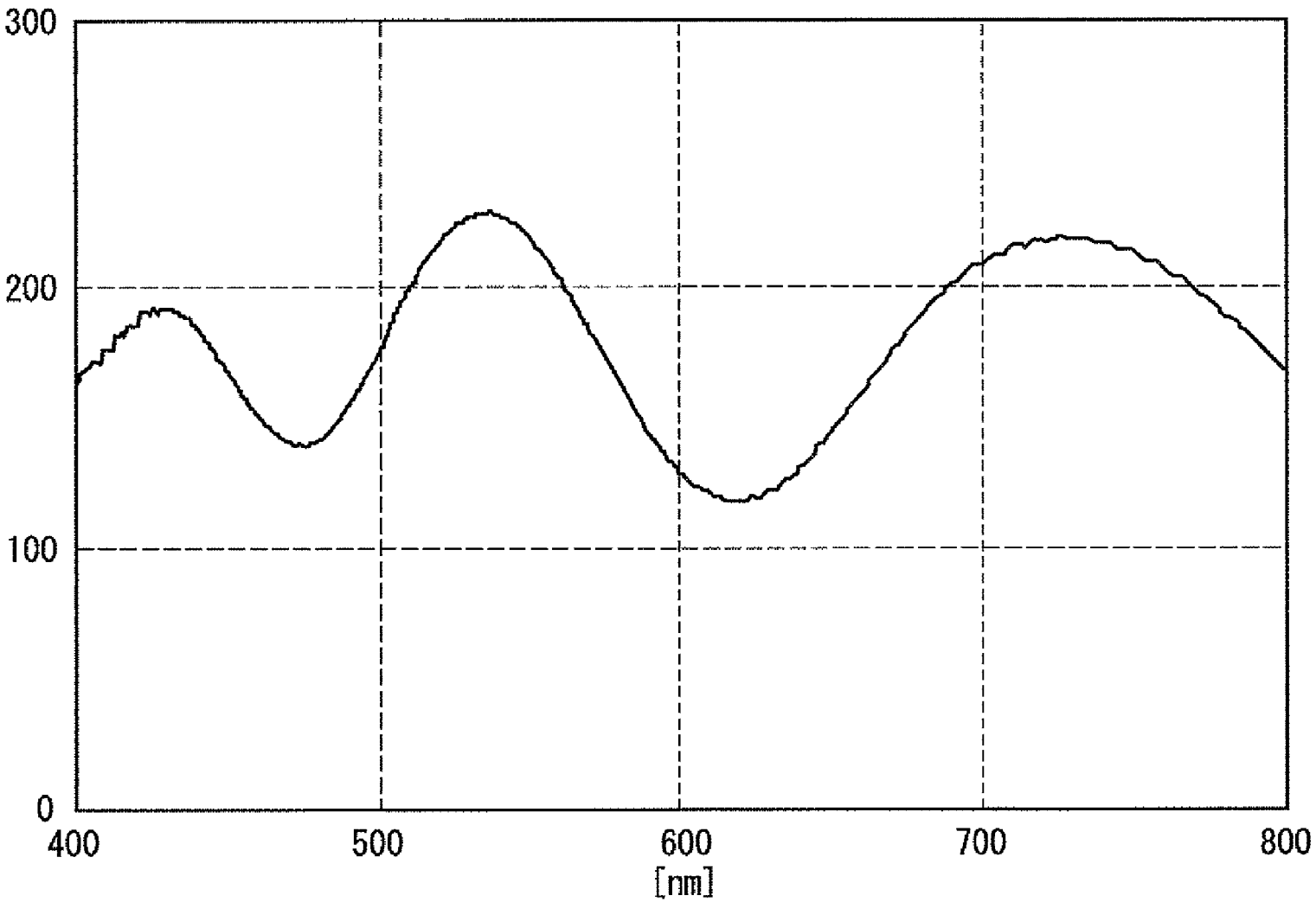
FIG. 7C is a graph illustrating measurement results of Comparative Examples.

The spectral reflection intensity spectrum of a comparative photoreceptor B1 described below in which the surface layer is formed directly on the non-coated photoreceptor is measured. The results are shown in FIG. 7C. The intensity difference between the maximum and minimum values of the reflection spectrum (value of variation in reflection intensity) is 110.

Figure 7D:
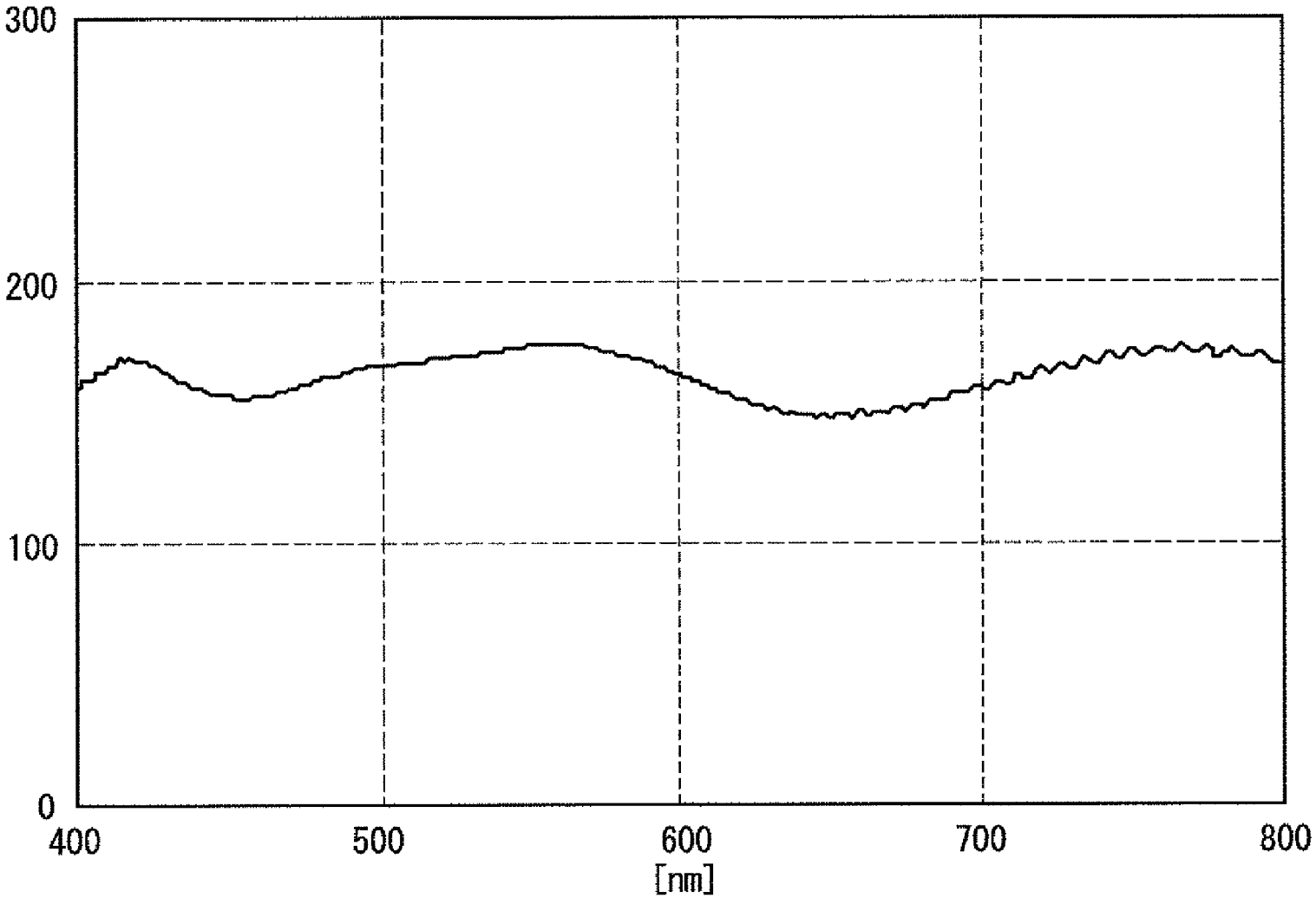
FIG. 7D is a graph illustrating measurement results of Examples.

Subsequently, the reflection spectrum of the photoreceptor A1 prepared in Example 1 in which the intermediate layer and the surface layer are formed on the non-coated photoreceptor in this order is measured in the same manner as described above. The results are shown in FIG. 7D. The intensity difference between the maximum and minimum values of the reflection spectrum (value of variation in reflection intensity) of the photoreceptor A1 prepared in Example 1 calculated from FIG. 7D is 30. The intensity difference thus obtained is compared with the intensity difference (value of 110) of the comparative photoreceptor B1 (see Comparative Example 1), and evaluated according to the following criteria. The value of variation in reflection intensity and the results of evaluation thereon are shown in Table 1.

G1: The ratio of the intensity difference relative to that of the comparative photoreceptor B1 is 1/3 or lower.

G2: The ratio of the intensity difference relative to that of the comparative photoreceptor B1 is greater than 1/3 but not greater than 3/5.

G3: The ratio of the intensity difference relative to that of the comparative photoreceptor B1 is greater than 3/5.

Evaluation Using Actual Machine

The electrophotographic properties of the organic photoreceptor A1 having an intermediate layer and a surface layer are evaluated. The surface of each of the non-coated photoreceptor not having the intermediate layer and surface layer or the photoreceptor A1 having the intermediate layer and surface layer is scan-irradiated with exposure light (light source:

semiconductor laser; wavelength: 780 nm; output power: 5 mW) while the photoreceptor is rotated at 40 rpm and negatively charged to −700 V by a scorotron charger. The surface potential of each photoreceptor after the irradiation is measured by using a surface electrometer (trade name: MODEL 344; manufactured by TREK Japan KK) under a condition of a temperature of 20° C. and a humidity of 50% RH. The result shows that the surface potential of the non-coated photoreceptor is −20 V, while that of the photoreceptor A1 having the intermediate layer and the surface layer is −40 V or less, that the degree that the surface potential of the photoreceptor A1 is affected by variations in temperature and humidity is small, and that the surface potential of the photoreceptor A1 is at a favorable level.

The influence on sensitivity is evaluated over the entire wavelength region from the infrared region to the visible region by changing the emission wavelength of the light source. As a result, it is found that there is almost no difference between the non-coated photoreceptor and the photoreceptor A1 having the intermediate layer and the surface layer. The result indicates that the sensitivity is not decreased by providing the intermediate layer and the surface layer.

In addition, peeling of the surface layer is not observed in a peel-off test in which an adhesive tape attached to the surface of the photoreceptor A1 having the intermediate layer and the surface layer is removed, showing that adhesion in the photoreceptor A1 is strong.

The photoreceptor A1 having the intermediate layer and the surface layer is evaluated using an image-forming apparatus (trade name: DOCUCENTRE COLOR a450, manufactured by Fuji Xerox Co., Ltd). This apparatus is equipped with an intermediate transfer belt, a charging roll and a cleaning blade, which are members that contact the photoreceptor.

Figure 8:
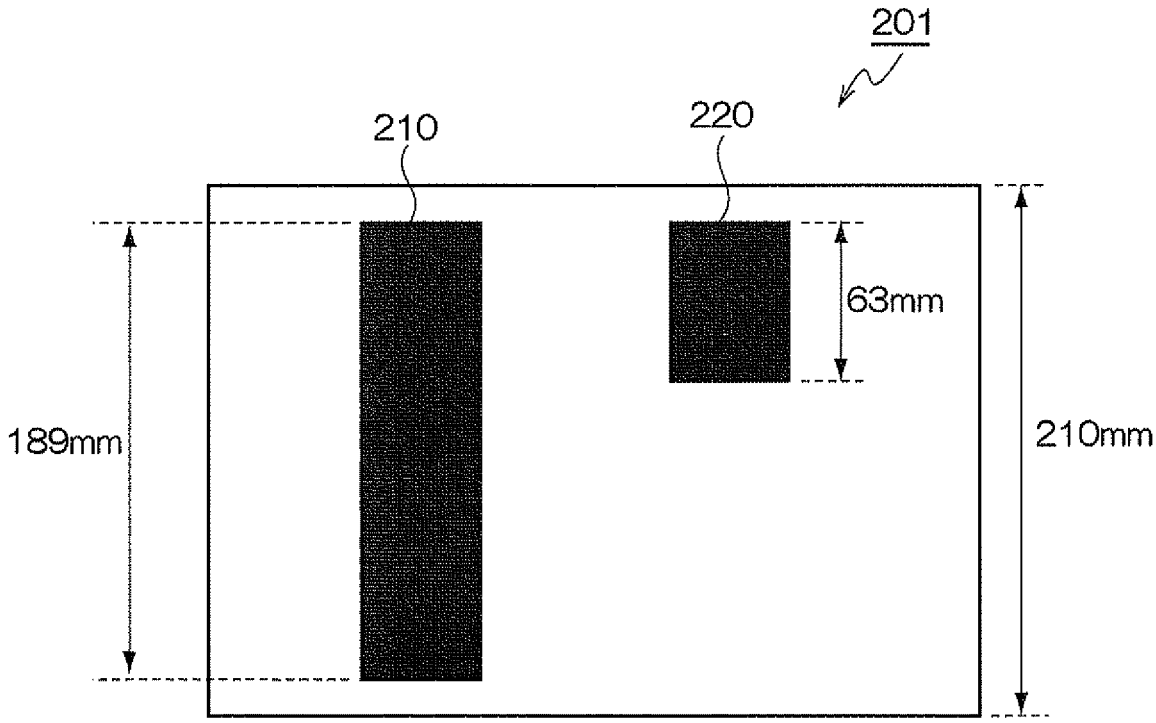
FIG. 8 is a plain view illustrating an image pattern used in a print test in Examples.

In the evaluation, after the photoreceptor is mounted, an image pattern as shown in FIG. 8 is sequentially printed on A4-size sheets of paper (trade name: P PAPER, manufactured by Fuji Xerox Co., Ltd) by setting the shorter sides of the sheets in parallel with the paper feed direction in an environment of a temperature of 20° C. and a humidity of 50% RH.

Here, the original image 201 as shown in FIG. 8 includes two image patterns—a solid image 210 having a length (189 mm) that is 90% of the length of the shorter sides of the sheet (solid portion length 90% image) and a solid image 220 having a length (63 mm) that is 30% of the length of the shorter sides of the sheet (solid portion length 30% image).

Unevenness in Image Density

The above striped images are formed on 50,000 sheets in sequence. Then, the second sheet printed after the printing on 50,000 sheets is taken as a sample sheets, and it is observed whether there is unevenness in image density on the samples sheet. The unevenness in image density is evaluated according to the following criteria.

G1: Uneven image density is not observed over the entire image area.

G2: Although unevenness in image density is not observed in the solid image portion having a length that is 30% of the length of the shorter sides of the sheet, strip-shaped unevenness in image density is slightly observed in the solid image portion having a length that is 90% of the length of the shorter sides of the sheet.

G3: Unevenness in image density is slightly observed in the solid image portion having a length that is 30% of the length of the shorter sides of the sheet, and strip-shaped unevenness in image density is clearly observed in the solid image portion having a length that is 90% of the length of the shorter sides of the sheet.

The results of the evaluation are collectively shown in Table 1.

Examples 2 to 10

In Example 2 to 6, photoreceptors A2 to A6 in which an intermediate layer and an surface layer are formed on the non-coated photoreceptor in this order are prepared in the same manner as in Example 1 except that the types and composition ratio of the contained elements and the film formation time are changed as shown in Table 1. The photoreceptors A2 to A6 thus obtained are evaluated in the same manner as in Example 1. The results of the evaluation are shown in Table 1. Further, in Examples 7 to 10, photoreceptors A7 to A10 in which an intermediate layer and an surface layer are formed on the non-coated photoreceptor in this order are prepared in the same manner as in Example 1 except that the types and composition ratio of the contained elements and the film formation time are changed as shown in Table 1. The intermediate layers of the photoreceptors A7 to A10 contain Ga, N, and O. The photoreceptors A7 to A10 thus obtained are evaluated in the same manner as in Example 1, and the evaluation results are shown in Table 1.

Comparative Example 1

A comparative photoreceptor B1 is prepared in the same manner as in Example 1 except that an intermediate layer is not formed and a surface layer is formed directly on the non-coated photoreceptor. The photoreceptor B1 is evaluated in the same manner as in Example 1. The results of the evaluation are shown in Table 1.

Comparative Examples 2 and 3

Comparative photoreceptors B2 and B3 having an intermediate layer and a surface layer on the non-coated photoreceptor are prepared in the same manner as in Example 1 except that the types and composition ratio of the contained elements and the film formation time are changed as shown in Table 1. The photoreceptors B2 and B3 thus obtained are evaluated in the same manner as in Example 1. The results of the evaluation are shown in Table 1.

TABLE 1

| | | Example 1 | Example 2 | Example 3 | Example 4 | Example 5 | Example 6 | Example 7 |
|---|---|---|---|---|---|---|---|---|
| Photoreceptor | | A1 | A2 | A3 | A4 | A5 | A6 | A7 |
| Photosensitive layer | Refractive index (n1) | 1.68 | 1.68 | 1.68 | 1.68 | 1.68 | 1.68 | 1.68 |
| Intermediate | Elements | Ga/N/H | Ga/N/H | Ga/N/H | Ga/N/H | Ga/N/H | Ga/N/H | Ga/N/O/H |

TABLE 1-continued

| | | | | | | | | |
|---|---|---|---|---|---|---|---|---|
| layer | Contained Composition ratio (atomic %) | 1/0.7/0.2 | 1/0.7/0.2 | 1/0.7/0.2 | 1/0.7/0.2 | 1/0.7/0.2 | 1/0.7/0.2 | 1/0.5/0.4/0.7 |
| | Layer thickness (nm) | 15 | 70 | 50 | 30 | 10 | 5 | 15 |
| | Refractive index (n2) | 1.95 | 1.95 | 1.95 | 1.95 | 1.95 | 1.95 | 2 |
| Surface layer | Elements Contained | Ga/O/H | Ga/O/H | Ga/O/H | Ga/O/H | Ga/O/H | Ga/O/H | Ga/O/H |
| | Composition ratio (atomic %) | 1/1.3/0.4 | 1/1.3/0.4 | 1/1.3/0.4 | 1/1.3/0.4 | 1/1.3/0.4 | 1/1.3/0.4 | 1/1.2/0.4 |
| | Layer thickness (nm) | 500 | 500 | 500 | 500 | 500 | 500 | 500 |
| | Refractive index (n3) | 1.87 | 1.87 | 1.87 | 1.87 | 1.87 | 1.87 | 1.87 |
| Relationship of refractive indices | | n2 > n3 > n1 | n2 > n3 > n1 | n2 > n3 > n1 | n2 > n3 > n1 | n2 > n3 > n1 | n2 > n3 > n1 | n2 > n3 > n1 |
| Surface property | Initial contact angle (°) | 90 | 92 | 92 | 92 | 92 | 92 | 95 |
| | variation in reflection intensity | 30 | 65 | 60 | 40 | 30 | 40 | 25 |
| | Evaluation on variation in reflection intensity | G1 | G2 | G2 | G2 | G1 | G2 | G1 |
| Evaluation using actual machine | Unevenness in image density | G1 | G2 | G2 | G2 | G1 | G2 | G1 |

| | | | Example 8 | Example 9 | Example 10 | Comp. Example 1 | Comp. Example 2 | Comp. Example 3 |
|---|---|---|---|---|---|---|---|---|
| Photoreceptor | | | A8 | A9 | A10 | B1 | B2 | B3 |
| | Photosensitive layer | Refractive index (n1) | 1.68 | 1.68 | 1.68 | 1.68 | 1.68 | 1.68 |
| | Intermediate layer | Elements Contained | Ga/N/O/H | Ga/N/O/H | Ga/N/O/H | — | Ga/N/H | Ga/N/O/H |
| | | Composition ratio | 1/0.5/0.4/0.7 | 1/0.3/0.5/0.7 | 1/0.3/0.5/0.7 | — | 1/0.7/0.2 | 1/0.5/0.4/0.7 |
| | | Layer thickness (nm) | 2 | 15 | 20 | — | 80 | 1 |
| | | Refractive index (n2) | 2 | 2.05 | 2.05 | — | 1.95 | 2 |
| | Surface layer | Elements Contained | Ga/O/H | Ga/O/H | Ga/O/H | Ga/O/H | Ga/O/H | Ga/O/H |
| | | Composition ratio (atomic %) | 1/1.3/0.4 | 1/1.2/0.4 | 1/1.2/0.4 | 1/1.3/0.4 | 1/1.3/0.4 | 1/1.3/0.4 |
| | | Layer thickness (nm) | 500 | 500 | 500 | 500 | 500 | 500 |
| | | Refractive index (n3) | 1.87 | 1.87 | 1.87 | 1.87 | 1.87 | 1.87 |
| Relationship of refractive indices | | | n2 > n3 > n1 | n2 > n3 > n1 | n2 > n3 > n1 | n2 > n1 | n2 > n3 > n1 | n2 > n3 > n1 |
| | Surface property | Initial contact angle (°) | 92 | 95 | 95 | 92 | 92 | 92 |
| | | variation in reflection intensity | 50 | 25 | 30 | 110 | 90 | 100 |
| | | Evaluation on variation in reflection intensity | G2 | G1 | G1 | G3 | G3 | G3 |
| | Evaluation using actual machine | Unevenness in image density | G2 | G1 | G1 | G3 | G3 | G3 |

As shown in Table 1, in the photoreceptors A1 to A10 of Examples 1 to 10, in which an intermediate layer having a layer thickness within a range of from 5 nm to 70 nm is formed on a photosensitive layer and a surface layer is formed on an intermediate layer and the refractive indices of the photosensitive layer, the intermediate layer, and the surface layer satisfy Inequality (1), generation of unevenness in image density is not observed even when the thickness of the surface layer is changed, as compared with the comparative photoreceptor B1 of Comparative Example 1 not having the intermediate layer and the comparative photoreceptors B2 and B3 in which the refractive indices of the photosensitive layer, the intermediate layer, and the surface layer do not satisfy Inequality (1).

As is understood from the evaluation results of the variation in reflection intensity in Table 1, the photoreceptors A1 to A10 of Examples 1 to 10 have smaller variation in reflection intensity as compared with those of the comparative photoreceptors B1 to B3 of Comparative Examples 1 to 3. Therefore, it is supposed that the reflection intensity and spectrum of the photoreceptors A1 to A10 is less influenced by a change in the thickness of the surface layer, which leads to suppression of unevenness in image density.

What is claimed is:

1. An electrophotographic photoreceptor comprising a conductive substrate, and a photosensitive layer, an intermediate layer having a thickness of about 2 nm to about 70 nm, and a surface layer, which are disposed in this order on the conductive substrate, a refractive index n1 of the photosensitive layer, a refractive index n2 of the intermediate layer, and a refractive index n3 of the surface layer satisfying the following Inequality (1):

$$n2>n3>n1 \qquad \text{Inequality (1)}$$

wherein the intermediate layer comprises a first material containing Ga and at least one of oxygen or nitrogen, the surface layer comprises a second material containing Ga and at least one of oxygen or nitrogen, and the first material and the second material have different compositional formulae.

2. The electrophotographic photoreceptor of claim 1, further comprising an undercoat layer between the conductive substrate and the photosensitive layer, and the photosensitive layer comprises a charge generation layer containing a phthalocyanine compound and a charge transport layer containing a compound represented by the following Formula (1) and a polymer whose repeating unit is represented by the following Formula (2):

Formula (1)

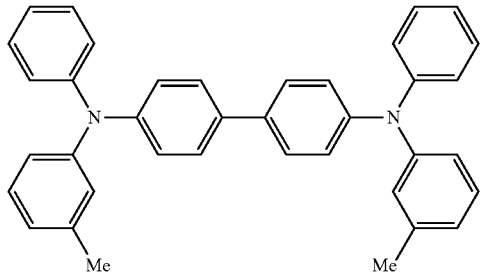

Formula (2)

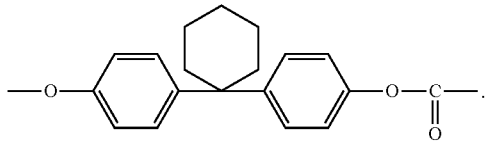

3. The electrophotographic photoreceptor of claim 1, wherein a difference between the refractive index n1 of the photosensitive layer and the refractive index n2 of the intermediate layer is from about 0.1 to about 1.0.

4. The electrophotographic photoreceptor of claim 1, wherein a difference between the refractive index n1 of the photosensitive layer and the refractive index n2 of the intermediate layer is from about 0.3 to about 0.7.

5. The electrophotographic photoreceptor of claim 1, wherein a difference between the refractive index n2 of the intermediate layer and the refractive index n3 of the surface layer is from about 0.01 to about 0.7.

6. The electrophotographic photoreceptor of claim 1, wherein a difference between the refractive index n2 of the intermediate layer and the refractive index n3 of the surface layer is from about 0.03 to about 0.5.

7. The electrophotographic photoreceptor of claim 1, wherein the thickness of the intermediate layer is from about 5 nm to about 60 nm.

8. A process cartridge integrally comprising:

an electrophotographic photoreceptor; and at least one unit selected from the group consisting of a charging unit that charges the electrophotographic photoreceptor, a developing unit that develops an electrostatic latent image formed on the charged electrophotographic photoreceptor with a toner-containing developer, and a cleaning unit that removes a substance adhered to a surface of the electrophotographic photoreceptor, the electrophotographic photoreceptor including a conductive substrate, and a photosensitive layer, an intermediate layer having a thickness of about 2 nm to about 70 nm, and a surface layer, which are disposed in this order on the conductive substrate, and a refractive index n1 of the photosensitive layer, a refractive index n2 of the intermediate layer, and a refractive index n3 of the surface layer satisfying the following Inequality (2):

$$n2>n3>n1 \qquad \text{Inequality (2)}$$

wherein the intermediate layer comprises a first material containing Ga and at least one of oxygen or nitrogen, the surface layer comprises a second material containing Ga and at least one of oxygen or nitrogen, and the first material and the second material have different compositional formulae.

9. The process cartridge of claim 8, further comprising an undercoat layer between the conductive substrate and the photosensitive layer, and the photosensitive layer comprises a charge generation layer containing a phthalocyanine compound and a charge transport layer containing a compound represented by the following Formula (1) and a polymer whose repeating unit is represented by the following Formula (2):

Formula (1)

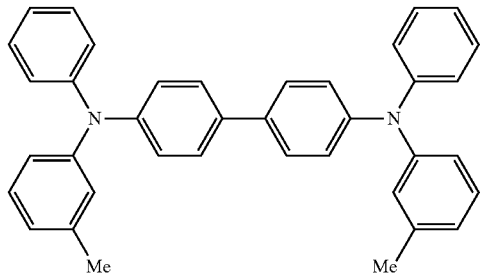

Formula (2)

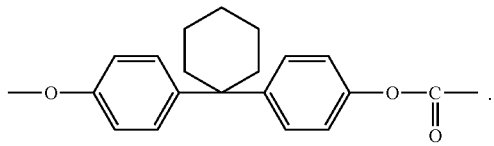

10. The process cartridge of claim 8, wherein a difference between the refractive index n1 of the photosensitive layer and the refractive index n2 of the intermediate layer is from about 0.1 to about 1.0.

11. The process cartridge of claim 8, wherein a difference between the refractive index n2 of the intermediate layer and the refractive index n3 of the surface layer is from about 0.01 to about 0.7.

12. The process cartridge of claim 8, wherein the thickness of the intermediate layer is from about 5 nm to about 60 nm.

13. An image-forming apparatus comprising:

an electrophotographic photoreceptor;

a charging unit that charges the electrophotographic photoreceptor;

an electrostatic latent image forming unit that forms an electrostatic latent image on the charged electrophotographic photoreceptor;

a developing unit that forms a toner image by developing the electrostatic latent image with a toner-containing developer; and a transfer unit that transfers the toner image onto a recording medium, the electrophotographic photoreceptor including a conductive substrate, and a photosensitive layer, an intermediate layer having a thickness of about 2 nm to about 70 nm, and a surface layer, which are disposed in this order on the conductive substrate, and a refractive index n1 of the photosensitive layer, a refractive index n2 of the intermediate layer, and a refractive index n3 of the surface layer satisfying the following Inequality (3):

$$n2>n3>n1 \qquad \text{Inequality (3)}$$

wherein the intermediate layer comprises a first material containing Ga and at least one of oxygen or nitrogen, the surface layer comprises a second material containing Ga and at least one of oxygen or nitrogen, and the first material and the second material have different compositional formulae.

14. The image-forming apparatus of claim 13, further comprising an undercoat layer between the conductive substrate and the photosensitive layer, and the photosensitive layer comprises a charge generation layer containing a phthalocyanine compound and a charge transport layer containing a compound represented by the following Formula (1) and a polymer whose repeating unit is represented by the following Formula (2):

Formula (1)

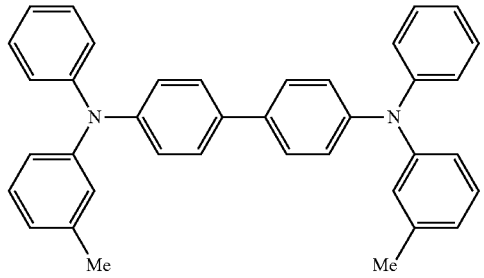

Formula (2)

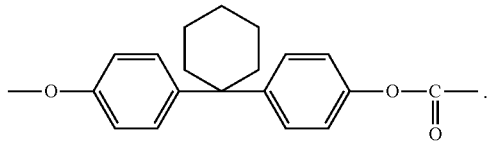

15. The image-forming apparatus of claim 13, wherein a difference between the refractive index n1 of the photosensitive layer and the refractive index n2 of the intermediate layer is from about 0.1 to about 1.0.

16. The image-forming apparatus of claim 13, wherein a difference between the refractive index n2 of the intermediate layer and the refractive index n3 of the surface layer is from about 0.01 to about 0.7.

17. The image-forming apparatus of claim 13, wherein the thickness of the intermediate layer is from about 5 nm to about 60 nm.

* * * * *